US006043638A

United States Patent [19]

Tobita

[11] Patent Number: 6,043,638

[45] Date of Patent: Mar. 28, 2000

[54] REFERENCE VOLTAGE GENERATING CIRCUIT CAPABLE OF GENERATING STABLE REFERENCE VOLTAGE INDEPENDENT OF OPERATING ENVIRONMENT

[75] Inventor: Youichi Tobita, Hyogo, Japan

[73] Assignee: Mitsubishi Denki Kabushiki Kaisha, Tokyo, Japan

[21] Appl. No.: 09/321,242

[22] Filed: May 27, 1999

[30] Foreign Application Priority Data

Nov. 20, 1998 [JP] Japan ..... 10-330919

[51] Int. Cl.[7] ..... G05F 3/04; G05F 3/16

[52] U.S. Cl. ..... 323/313; 323/312

[58] Field of Search ..... 323/313, 312, 323/311, 314

[56] References Cited

U.S. PATENT DOCUMENTS

| | | | |
|---|---|---|---|
| Re. 34,290 | 6/1993 | Tobita | 323/313 |
| 5,278,491 | 1/1994 | Nitta et al. | 323/313 |
| 5,315,230 | 5/1994 | Corboda et al. | 323/313 |
| 5,384,740 | 1/1995 | Etoh et al. | 365/189.09 |
| 5,391,979 | 2/1995 | Kajimoto et al. | 323/313 |
| 5,594,326 | 1/1997 | Gilbert | 323/313 |
| 5,646,516 | 7/1997 | Tobita | 323/313 |
| 5,780,921 | 7/1998 | Mitsuishi | 323/313 |
| 5,920,185 | 7/1999 | Ozoe | 323/315 |
| 5,949,227 | 9/1999 | Bujanos | 323/313 |

FOREIGN PATENT DOCUMENTS

| | | | |
|---|---|---|---|
| 2-67610 | 3/1990 | Japan | G05F 3/24 |
| 2-245810 | 10/1990 | Japan | G05F 3/24 |
| 4-104517 | 4/1992 | Japan | G05F 3/22 |

*Primary Examiner*—Peter S. Wong
*Assistant Examiner*—Bao Q. Vu
*Attorney, Agent, or Firm*—McDermott, Will & Emery

[57] ABSTRACT

Of output MOS transistors for charging and discharging an output node, a charging MOS transistor has a gate receiving a voltage from a gate control circuit including a feedback loop such that power supply voltage dependency of an output voltage from the output node can be eliminated. Further, a source follower transistor is provided to the gate of the discharging MOS transistor or the output node, to eliminate temperature dependency of this output voltage. A reference voltage is generated at a constant voltage level independent of operating environment.

20 Claims, 18 Drawing Sheets

REFERENCE VOLTAGE GENERATING CIRCUIT CAPABLE OF GENERATING STABLE REFERENCE VOLTAGE INDEPENDENT OF OPERATING ENVIRONMENT

BACKGROUND OF THE INVENTION

1. Field of the Invention

The present invention relates to a circuit for generating a reference voltage at a prescribed voltage level in a semiconductor device, and more particularly to a reference voltage generating circuit capable of generating a reference voltage exhibiting an extremely small dependency on power supply voltage and operating temperature.

2. Description of the Background Art

In a semiconductor integrated circuit, a reference voltage at a constant voltage level independent of an external or internal power supply voltage is required, for example, in the following case. To realize a circuit integrated with higher density, semiconductor elements being components thereof are downscaled. The breakdown voltage of such miniaturized semiconductor element is lowered, and thus, the power supply voltage (operating power supply voltage) of the semiconductor integrated circuit having those miniaturized semiconductor elements as its components need to be lowered. Practically, however, the external power supply voltage cannot always be lowered. In the case of a DRAM (dynamic random access memory) having a large storage capacity, for example, the power supply voltage (operating power supply voltage) is lowered from the standpoints of breakdown voltage, operating speed and power dissipation of elements. However, components of external devices such as a microprocessor and a logic LSI have not been miniaturized to the extent of those of DRAM, and therefore, their power supply voltages cannot be lowered to the level of that of DRAM. Consequently, when a system using a DRAM, a microprocessor and others is to be formed, a power supply voltage at a high voltage level that is required by the microprocessor, logic LSI and so on is used as a system power supply.

When the system power supply or the external power supply voltage is relatively high, a semiconductor device requiring a low operating power supply voltage, such as a DRAM, is provided with a circuit for internally down-converting the external power supply voltage to generate an internal power supply voltage.

FIG. 29 is a diagram schematically showing the entire configuration of a semiconductor device, e.g., a DRAM, incorporating such internal voltage down converter. Referring to FIG. 29, the semiconductor device 900 includes: an external power supply line 902 for transmitting an external power supply voltage EXV supplied to a power supply terminal 901; another power supply line (hereinafter, referred to as a ground line) 904 for transmitting the other power supply voltage (hereinafter, referred to as a ground voltage) Vss supplied to the other power supply node (hereinafter, referred to as a ground node) 903; and an internal voltage down converter 905 that operates using voltages EXV and Vss on external power supply line 902 and on ground line 904, respectively, as both operating power supply voltages, for down-converting external power supply voltage EXV to generate an internal power supply voltage VCI on an internal power supply line 906. This voltage down converter 905, of which a configuration will be described later, has a function to generate a stable internal power supply voltage VCI within a certain range of external power supply voltage EXV, independent of its fluctuation.

Semiconductor device 900 further includes: an internal power supply utilizing circuit 907 that operates using voltages VCI and Vss on internal power supply line 906 and ground line 904, respectively, as both operating power supply voltages; and an external power supply utilizing circuit 908 that operates using external power supply voltage EXV on external power supply line 902 and ground voltage Vss on ground line 904 as both operating power supply voltages. External power supply utilizing circuit 908 is connected to an input/output terminal 909 and has a function to interface with an external device. By generating internal power supply voltage VCI at a prescribed voltage level within semiconductor device 900, it is possible to guarantee the breakdown voltage of elements included in internal power supply utilizing circuit 907 of its main component, as well as to improve operating speed, and to reduce power dissipation.

FIG. 30 is a diagram schematically showing a configuration of the internal voltage down converter 905 shown in FIG. 29. In FIG. 30, internal voltage down converter 905 includes: a reference voltage generating circuit 910 for generating a reference voltage Vref at a constant voltage level from external power supply voltage EXV supplied to external power supply terminal 901; a comparison circuit 912 for comparing internal power supply voltage VCI on internal power supply line 906 with reference voltage Vref; and a drive element 914 formed of a p channel MOS transistor (insulated gate type field effect transistor) 914 for supplying a current from external power supply terminal 901 to internal power supply line 906 in accordance with an output signal of comparison circuit 912.

Comparison circuit 912 has a positive input receiving internal power supply voltage VCI, and a negative input receiving reference voltage Vref. Comparison circuit 912, which is normally composed of a differential amplifier, differentially amplifies internal power supply voltage VCI and reference voltage Vref. The operation of the internal voltage down converter shown in FIG. 30 will now be described in brief.

Reference voltage generating circuit 910 generates reference voltage Vref at a constant voltage level independent of external power supply voltage EXV. In the case where internal power supply voltage VCI on internal power supply line 906 is higher than this reference voltage Vref, the output of comparison circuit 912 is at an "H" level, and drive element 914 is in an OFF state. In this state, no current is supplied from external power supply terminal 901 to internal power supply line 906.

In contrast, when internal power supply voltage VCI is lower than reference voltage Vref, the output of comparison circuit 912 attains a low level in accordance with the difference between internal power supply voltage VCI and reference voltage Vref. Drive element 914 increased in its conductance supplies a current from external power supply terminal 901 to internal power supply line 906 to raise the voltage level of internal power supply voltage VCI. Internal power supply voltage VCI is kept at the voltage level of reference voltage Vref by a feedback loop formed of comparison circuit 912, drive element 914 and internal power supply line 906.

As explained above, since the voltage level of internal power supply voltage VCI is determined by reference voltage Vref, reference voltage Vref is required to have a small temperature dependency as well as a small dependency on external power supply voltage EXV within a prescribed range of the external power supply voltage EXV, from the standpoint of stable operation of internal power supply utilizing circuit 907 (see FIG. 40).

Such reference voltage is used in a variety of applications besides the above-described internal voltage down converter. For example, in an input circuit receiving an external signal and generating an internal binary signal, such reference voltage is used to determine logical levels of H level and L level of the external signal. In addition, in a memory device having no complementary type read data, such as a read only memory (ROM), the reference voltage is used in a circuit for reading and amplifying memory cell data to determine the H and L levels of the memory cell data.

The reference voltage is also utilized as a bias voltage of a constant current source element included in the differential amplifying circuit. This bias voltage of the constant current element determines a power supply current of the differential amplifying circuit as well as its response speed. Thus, the reference voltage is used both in digital and analog integrated circuits.

FIG. 31 shows a configuration of a conventional reference voltage generating circuit disclosed in Japanese Patent Laying-Open No. 2-67610, for example. Here, the reference voltage may be generated from any of an external power supply voltage or an internal power supply voltage. Thus, the power supply voltage in FIG. 31 is denoted by "Vcc" to include both external and internal power supply voltages.

In FIG. 31, the reference voltage generating circuit includes: an enhancement type p channel MOS transistor Q1 connected between a power supply node 1 and an output node 2 for supplying a current from power supply node 1 to output node 2 according to a voltage on a node 3; an enhancement type p channel MOS transistor Q2 connected between output node 2 and a ground node 4 and having its gate connected to ground node 4; an enhancement type p channel MOS transistor Q3 connected between power supply node 1 and node 3 for clamping the voltage on node 3 at a prescribed voltage level; and a resistance element 5 connected between node 3 and ground node 4 and having a resistance value R1.

MOS transistors Q1, Q2 and Q3 have threshold voltages VTP1, VTP2 and VTP3, respectively. MOS transistor Q3 has its gate and drain interconnected, and its backgate connected to power supply node 1. The backgate of MOS transistor Q1 is connected to power supply node 1, and the backgate of MOS transistor Q2 is connected to output node 2. The source and backgate of MOS transistor Q2 are adapted to have the same potential to eliminate backgate effects. The operation of reference voltage generating circuit shown in FIG. 31 will now be described.

Now, conductance factors β of MOS transistors Q1, Q2 and Q3 are expressed as β1, β2 and β3, and the voltage on node 3 as V3. Here, conductance factor β is a constant that is proportional to the ratio between channel width W and channel length L. Assuming that MOS transistors Q1 to Q3 all operate in a saturation region, a drain current IDS flowing through MOS transistors Q1 and Q2 when the voltage on power supply node 1 is Vcc can be expressed by the following equation.

$$IDS = (\beta 1/2)(V3 - Vcc - VTP1)^2 = (\beta 2/2)(-Vo - VTP2)^2 \quad (1)$$

where Vo represents an output voltage at output node 2. In the case where resistance value R1 of resistance element 5 is sufficiently large relative to an equivalent resistance value (ON resistance) of MOS transistor Q3, MOS transistor Q3 operates in a diode mode, and the voltage V3 of node 3 is expressed by the following equation.

$$V3 \approx Vcc + VTP3 - \sqrt{2(Vcc + VTP3)/\beta 3 \cdot R1} \quad (2)$$

In the above equation (2), the third term on the right side represents contribution of channel resistance component of MOS transistor Q3. The equation (2) is derived from an equation for calculating the voltage of node 3 from a drain current of MOS transistor Q3 operating in a saturation region and resistance element 5. In the approximate expression, resistance value R1 of resistance element 5 is sufficiently large, so that the term 1/R1·β3 is neglected. The voltage Vo generated on output node 2 is obtained by the following equation from equations (1) and (2).

$$Vo = (\beta 1/\beta 2)^{1/2} \cdot \left(VTP1 - VTP3 + \sqrt{2(Vcc + VTP3)/\beta 3 \cdot R1}\right) - VTP2 \quad (3)$$

As seen from this equation (3), output voltage Vo is determined by threshold voltages VTP1 to VTP3 of respective MOS transistors Q1 to Q3, conductance factors β1 to β3 of respective MOS transistors Q1 to Q3, and resistance value R1 of resistance element 5. As shown in the third term in the first term of this equation (3), however, power supply voltage Vcc is included as a determining factor, and therefore, output voltage Vo depends on this power supply voltage Vcc on power supply node 1 to some extent.

More specifically, as shown in FIG. 32, output voltage Vo increases as power supply voltage Vcc increases. Even when reaching a fixed value, however, power supply voltage Vcc does not stabilize at that fixed value as shown with a dotted line in FIG. 32, but continues to increase in accordance with the increase of power supply voltage Vcc. If this output voltage Vo is used as a reference voltage for generating the above-described internal power supply voltage, there arise problems that the internal power supply voltage will change dependent on the change in the external power supply voltage, and that the operation timing in the internal circuits will vary (due to the increase in operating speed of MOS transistors being components thereof), which leads to decrease in operating margin of the internal circuits.

In addition to the above-described problems related to the power supply voltage dependency of the output voltage, there is another problem that is attributable to temperature dependency of the threshold voltage of MOS transistor. More specifically, as shown in FIG. 33, the threshold voltage VTN of n channel MOS transistor decreases as temperature T increases, and conversely, the threshold voltage VTP of p channel MOS transistor increases (i.e., the absolute value becomes smaller) according to the increase of temperature T. Note that, in FIG. 33, the abscissa represents temperature T, and the ordinate represents voltage value V.

Reviewing the above equation (3) from the standpoint of the temperature dependency of threshold voltage, a difference between threshold voltages VTP1 and VTP3 is obtained in the first term on the right side, and the temperature dependencies of these threshold voltages VTP1 and VTP3 are canceled. In the third term of the first term on the right side, however, there exists threshold voltage VTP3. In the second term on the right side of equation (3), threshold voltage VTP2 exists. Since these threshold voltages VTP3 and VTP2 are different in order, their temperature dependencies are not canceled, and thus, the temperature dependency of the threshold voltage VTP2 significantly appears on output voltage Vo. That is, the output voltage Vo has temperature dependency mainly attributable to the temperature dependency of threshold voltage VTP2. Therefore, there arises a problem that output voltage Vo from this reference voltage generating circuit changes according to the change of operating environment (operating temperature and power supply voltage), and thus, it is impossible to generate a reference voltage that can be held constantly at a stable, fixed level.

In practical use, this output voltage can be used in some cases even when it exhibits some dependency on power supply voltage or temperature. However, such power supply voltage or temperature dependency of output voltage Vo is preferred to be as small as possible such that an internal circuit can stably operate in the event of fluctuation of power supply voltage Vcc or temperature.

SUMMARY OF THE INVENTION

An object of the present invention is to provide a reference voltage generating circuit capable of stably generating a reference voltage at a constant voltage level, independent of change in operating environment.

Another object of the present invention is to provide a reference voltage generating circuit capable of generating a reference voltage exhibiting an extremely small dependency on a power supply voltage.

In summary, the present invention uses a negative feedback loop to adjust a gate voltage of a MOS transistor generating an output voltage, so as to prevent effects of a power supply voltage on the output voltage.

More specifically, the reference voltage generating circuit according to the present invention includes: a first output field effect transistor having a first threshold voltage and a gate, for supplying from a first power supply node to an output node a current dependent on a voltage applied to the gate; a second output field effect transistor having a second threshold voltage and a gate that receives a bias voltage, for discharging a current from a second power supply node to an output node dependent on the bias voltage; and a gate control circuit for applying to the gate of the first output field effect transistor such a voltage to cancel dependency of a voltage at the output node on a voltage at the first power supply node. The gate control circuit includes a feedback loop for holding the gate voltage of the first output field effect transistor at a prescribed voltage level through negative feedback of that gate voltage.

By forming the negative feedback loop using a feedback transistor and by adjusting the output node voltage of the negative feedback loop, it becomes possible to output from this negative feedback loop a voltage at a constant voltage level. Consequently, it becomes possible to substantially eliminate dependency of a voltage output from a succeeding circuit on the voltage of the first power supply node.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

First Embodiment

Figure 1:
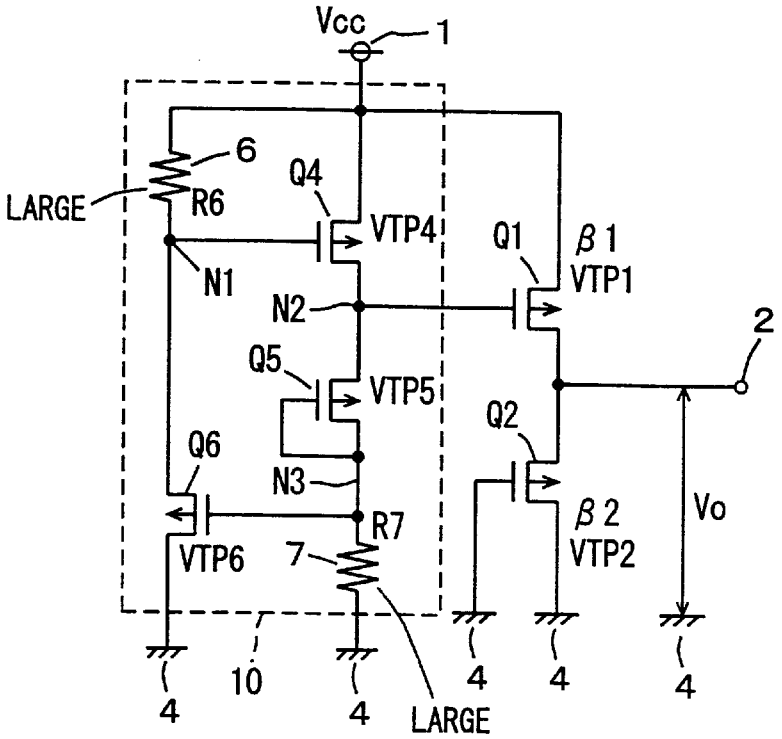
FIG. 1 is a diagram showing a configuration of a reference voltage generating circuit according to a first embodiment of the present invention.

FIG. 1 shows a configuration of a reference voltage generating circuit according to the first embodiment of the present invention. Referring to FIG. 1, the reference voltage generating circuit includes: an output MOS transistor Q1 composed of a p channel MOS transistor for supplying a current from a power supply node 1 to an output node 2 according to its gate voltage; a second output MOS transistor Q2 composed of a p channel MOS transistor having its gate connected to a ground node 4 for discharging output node 2 to a ground voltage level; and a gate control circuit 10 for setting a gate voltage of the first output MOS transistor Q1. Gate control circuit 10 applies to the gate of output MOS transistor Q1 a voltage for canceling the power supply voltage dependency of the output voltage Vo of output node 2.

Gate control circuit 10 includes: a resistance element 6 of high resistance connected between power supply node 1 and a node N1; a p channel MOS transistor Q4 connected between power supply node N1 and node N2 and having its gate connected to node N1; a diode-connected p channel MOS transistor Q5 connected between node N2 and node N3; a p channel MOS transistor Q6 connected between node N1 and ground node 4 and having its gate connected to node N3; and a resistance element 7 of high resistance connected between node N3 and ground node 4.

The resistance value R6 of resistance element 6 is set to a value that is sufficiently larger than ON resistance (equivalent conduction resistance) of MOS transistor Q6. Resistance value R7 of resistance element 7 is set to a value sufficiently larger than ON resistance of MOS transistors Q4 and Q5. Each of resistance elements 6 and 7 may be formed using any of high melting point metal such as polycrystalline silicon (or polysilicon), impurity diffusion resistance, or resistance-connected MOS transistor.

Node N2 of gate control circuit 10 is connected to the gate of output MOS transistor Q1. The operation of the reference voltage generating circuit shown in FIG. 1 will now be described.

Gate control circuit 10 constitutes a negative feedback circuit, and holds node N2 at a fixed voltage level. Now, conductance of MOS transistor Q6 decreases as the voltage of node N3 increases. Since resistance value R6 of resistance element 6 is set to a value sufficiently larger than ON resistance of MOS transistor Q6, MOS transistor Q6 operates in a source follower mode. MOS transistor Q6 is a p channel MOS transistor, and its source node is node N1. Therefore, voltage increase in node N3 is transmitted to node N1 due to the source follower mode operation of this MOS transistor Q6, and thus, the voltage level of node N1 increases. In response, conductance of MOS transistor Q4 decreases, its supplying current amount decreases, and thus, the voltage level of node N2 decreases. Resistance value R7 of resistance element 7 is set to a value that is sufficiently larger than ON resistance of MOS transistors Q5 and Q4. MOS transistor Q5 operating in a diode mode decreases the voltage at node N2 by an absolute value of its threshold voltage, and transmits the resulting voltage to node N3. Accordingly, when the voltage of node N3 increases, its voltage level is lowered by the feedback loop of MOS transistors Q6, Q4 and Q5. The voltage increase at node N3 is thus suppressed.

Conversely, when the voltage level of node N3 drops, the voltage level at node N1 drops due to the source follower mode operation of MOS transistor Q6, conductance of MOS transistor Q4 increases (due to increase of the gate to source voltage), and thus, the voltage level of node N2 increases. This voltage increase of node N2 is transmitted to node N3 via diode-connected MOS transistor Q5, and thus, the voltage at node N3 increases. Accordingly, when the voltage at node N3 changes, that voltage change is compensated for by the feedback loop of MOS transistors Q6, Q4 and Q5, and thus, node N3 is held at a constant voltage level.

MOS transistor Q4 inverts and amplifies the voltage of node N1 and transmits the resulting voltage to node N2. Resistance values R6 and R7 of resistance elements 6 and 7 are sufficiently larger than ON resistance of MOS transistors Q4 to Q6, and thus, only a minute current flows through these MOS transistors Q4 to Q6. Therefore, the voltage level at node N1 becomes a voltage level at which MOS transistor Q4 barely conducts, and is expressed by the following equation.

$$V1=Vcc+VTP4 \tag{4}$$

where V1 is a voltage of node N1, and VTP4 is a threshold voltage of MOS transistor Q4.

Voltage V3 on node N3 is transmitted to node N1 by the source follower mode operation of MOS transistor Q6. Thus, voltage V3 of node N3 is lowered from voltage V1 on node N1 by an absolute value of the threshold voltage of MOS transistor Q6. Therefore, voltage V3 of node N3 is expressed by the following equation.

$$\begin{aligned} V3 &= V1 + VTP6 \\ &= Vcc + VTP4 + VTP6 \end{aligned} \tag{5}$$

where VTP6 is a threshold voltage of MOS transistor Q6. The voltage of node N2 is raised from the voltage of node N3 by an absolute value of the threshold voltage of MOS transistor Q5 due to the diode mode operation of this MOS transistor Q5. Therefore, voltage V2 on node N2 is expressed by the following equation.

$$\begin{aligned} V2 &= V3 - VTP5 \\ &= Vcc + VTP4 + VTP6 - VTP5 \end{aligned} \tag{6}$$

wherein VTP5 is a threshold voltage of MOS transistor Q5.

MOS transistor Q1 supplies a current to output node 2 according to this voltage V2 on node N2. Therefore, by substituting the above equation (6) into the previous equation (1) to calculate output voltage Vo, the output voltage Vo can be expressed by the following equation.

$$Vo=(\beta 1/\beta 2)^{1/2}(VTP1-VTP4-VTP6+VTP5)-VTP2 \tag{7}$$

As seen from equation (7), this output voltage Vo does not include a term that depends on power supply voltage Vcc. Therefore, output voltage Vo is free from power supply voltage dependency.

To simplify equation (7), MOS transistors Q4 to Q6 are assumed to have structures identical to each other. In this case, these MOS transistors Q4 to Q6 each have the same threshold voltage value. If this threshold voltage is expressed as VTP, equation (7) can be rearranged to obtain the following equation.

$$Vo=(\beta 1/\beta 2)^{1/2}(VTP1-VTP)-VTP2 \tag{8}$$

Further, if conductance factors β1 and β2 of respective MOS transistors Q1 and Q2 are made equal to each other (β1=β2), the above equation (8) can be simplified into the following equation (9).

$$Vo=(VTP1-VTP-VTP2) \tag{9}$$

Therefore, as shown in FIG. 1, by setting the gate voltage of output MOS transistor to a fixed value via the feedback loop, it is possible to supply a voltage that depends on power supply voltage Vcc to the gate of this output MOS transistor Q1, and consequently, to eliminate power supply voltage dependency of output voltage Vo.

Note that output voltage V2 of gate control circuit 10 is substantially constant if power supply potential Vcc is stable. Thus, gate control circuit 10 can also be utilized as a reference voltage generating circuit in an application where Vcc dependency is practically permitted.

Modification

Figure 2:
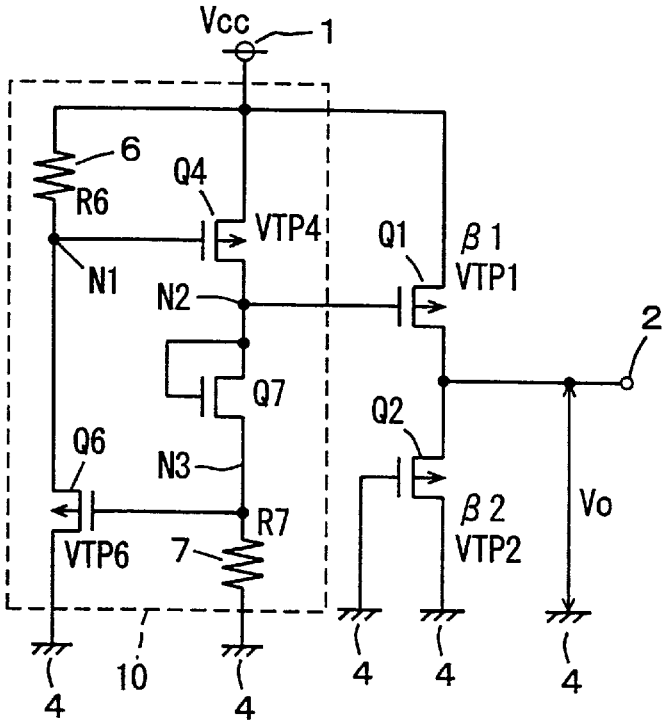
FIG. 2 is a diagram showing a configuration of a modification of the first embodiment of the present invention.

FIG. 2 shows a modification of the first embodiment of the present invention. In the configuration shown in FIG. 2, gate control circuit 10 includes an n channel MOS transistor Q7 in place of p channel MOS transistor Q5. MOS transistor Q7 has its gate connected to node N2. Resistance value R7 of resistance element 7 is sufficiently larger than ON resistance of this MOS transistor Q7, and MOS transistor Q7 operates in a diode mode. When the threshold voltage of MOS transistor Q7 is expressed as VTN7, the threshold voltage VTP5 in the above equation (7) is replaced by −VTN7, and thus, output voltage Vo is expressed by the following equation.

$$Vo=(\beta 1/\beta 2)^{1/2}(VTP1-VTP4-VTP6-VTN7)-VTP2 \quad (7A)$$

As seen from this equation (7A), even when diode-connected n channel MOS transistor Q7 is used, the power supply voltage dependency of output voltage Vo is canceled by the output voltage of this gate control circuit 10 as well as output MOS transistor Q1. Thus, the power supply voltage dependency can be eliminated.

As explained above, according to the first embodiment of the present invention, the gate voltage of a p channel MOS transistor is corrected by a feedback loop when it is used as an output transistor. The power supply voltage dependency of the output voltage of gate control circuit 10 can thus be canceled by output MOS transistor Q1. Accordingly, it is possible to eliminate the power supply voltage dependency of output voltage Vo, and thus, to generate output voltage Vo independent of fluctuation of the power supply voltage.

Second Embodiment

Figure 3:
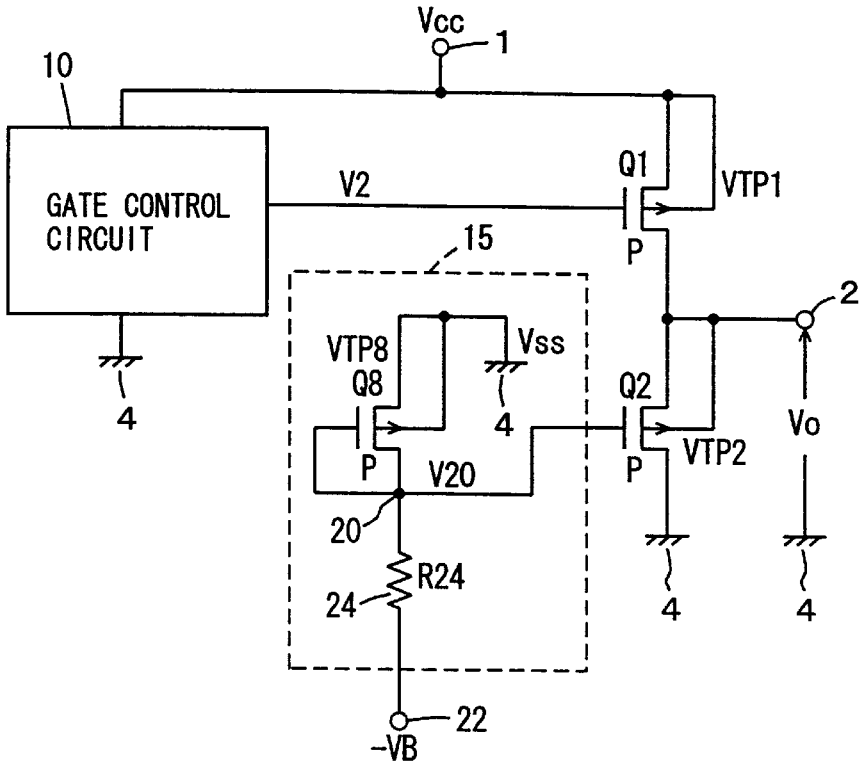
FIG. 3 is a diagram showing a configuration of a reference voltage generating circuit according to a second embodiment of the present invention.

FIG. 3 shows a configuration of a reference voltage generating circuit according to the second embodiment of the present invention. In the reference voltage generating circuit shown in FIG. 3, the gate of an output MOS transistor Q1 receives an output voltage V2 from a gate control circuit 10, and the gate of an output MOS transistor Q2 receives a bias voltage V2 from a bias circuit 15. Gate control circuit 10 has a configuration identical to that shown in FIG. 1 or 2.

Bias circuit 15 includes a p channel MOS transistor Q8. Connected between a ground node 4 and a node 20 and having its gate connected to node 20, and a resistance element 24 of high resistance connected between node 20 and a negative voltage supplying node 22. Resistance value R24. Of resistance element 24 is made sufficiently larger than ON resistance of p channel MOS transistor Q8. Negative voltage supplying node 22 receives a negative voltage −VB.

In this bias circuit 15, MOS transistor Q8 operates in a diode mode, and voltage V20 of node 20 becomes Vss+VTP8=VTP8. Here, ground voltage Vss is assumed to be 0V. Now, the operation of the reference voltage generating circuit shown in FIG. 3 will be described.

MOS transistors Q1, Q2 and Q8 are each assumed to be an enhancement type MOS transistor and to operate in a saturation region. When the power supply voltage supplied to power supply node 1 is voltage Vcc, a drain current IDS of MOS transistors Q1 and Q2 is expressed by the following equation.

$$IDS = (\beta 1/2)(V2 - Vcc - VTP1)^2 \quad (10)$$
$$= (\beta 2/2)(-V20 - Vo - VTP2)^2$$

Output voltage Vo is a voltage that appears on output node 2 relative to ground voltage Vss. Voltages V2 and V20 are calculated by the following equations, as described above.

$$V2=i\ Vcc+VTP4+VTP6-VTP5 \quad (11)$$

$$V20=VTP8 \quad (12)$$

From equations (10) through (12), output voltage Vo generated on output node 2 is expressed by the following equation.

$$Vo=(\beta 1/\beta 2)^{1/2}(VTP1-VTP4+VTP5-VTP6)+(VTP8-VTP2) \quad (13)$$

From equation (13), output voltage Vo is determined by threshold voltages VTP1, VTP2, VTP4 to VTP6, and VTP8 of respective MOS transistors Q1, Q2, Q4 to Q6, and Q8., and conductance factors β1 and β2 of respective MOS transistors Q1 and Q2. That is, equation (13) shows that output voltage Vo does not depend on power supply voltage Vcc supplied to power supply node 1. Further, the differences between threshold voltages are obtained in the first and second terms on the right side of equation (13). Accordingly, the temperature dependencies of threshold voltages are canceled, and thus, temperature dependency of output voltage Vo can be made small.

Preferably, the currents flowing through resistance elements 6 and 7 included in gate control circuit 10 and through resistance element 24 included in bias circuit 15 are made as small as possible, to accurately express internal voltages V2 and V2 each as a function of threshold voltage. Resistance values of resistance elements 6, 7 and 24 can be made sufficiently large as desired. Therefore, in gate control circuit 10 and bias circuit 15, it is possible to set voltage V2 from node N2 and voltage V2 from node N20 each accurately at a prescribed voltage level, independent of variation of resistance values due to the deviation of manufacturing parameter of resistance elements included therein (because of the sufficiently large resistance values).

Further, output voltage Vo depends on the ratio between conductance factors β1 and β2. As long as this β ratio β1/β2 is constant, respective conductance factors β1 and β2 can be made small as desired. By making these conductance factors β1 and β2 small, the current values flowing through MOS transistors Q1 and Q2 can be made small. The current dissipated in the entire reference voltage generating circuit can easily be reduced, and therefore, a reference voltage generating circuit dissipating low power can be realized. This output voltage Vo is used only as a comparing reference voltage, and thus, this reference voltage generating circuit does not need a large current drivability. Accordingly, making small the current values flowing through these MOS transistors Q1 and Q2 brings about no problem.

If threshold voltages VTP2 and VTP8 of respective MOS transistors Q2 and Q8 are made equal, the following equation (13A) is obtained.

$$Vo=(\beta 1/\beta 2)^{1/2}(VTP1-VTP4+VTP5-VTP6) \quad (13A)$$

As seen from equation (13A), output voltage Vo can be determined only by the threshold voltages of MOS transistors included in gate control circuit 10, the threshold voltage of output MSO transistor Q1, and conductance factors β1 and β2 of respective output MOS transistors Q1 and Q2. In addition, when threshold voltages of MOS transistors Q4, Q6 and Q5 included in gate control circuit 10 are all made equal, the following equation (13B) is obtained.

$$Vo=(\beta 1/\beta 2)^{1/2}(VTP1-VTP) \quad (13B)$$

Therefore, the effects of variation of threshold voltages due to deviation of a manufacturing parameter can also be canceled, and it is possible to generate output voltage Vo at a constant level, independent of deviation of a manufacturing parameter and of fluctuation of operating temperature as well as power supply voltage.

To change the threshold voltage of MOS transistor, various methods can be used as follows: (i) to change film thickness of the gate insulating film; (ii) to change material of the gate electrode (to use, e.g., aluminum and polysilicon); and (iii) to change, by ion-implantation, impurity concentration of the surface of semiconductor substrate immediately under the gate region (i.e., channel region). In actual circuit manufacturing, a smaller number of kinds of threshold voltages is preferable for the simplification of manufacturing process. Now, assuming that two kinds of threshold voltages VTP=−1.2V and VTP1=VTP2=VTP8=−0.7V are used and $(\beta 1/\beta 2)^{1/2}=7$, output voltage Vo can be obtained as a voltage expressed by the following equation.

$$Vo=7\cdot\{-0.7-(-1.2)\}=3.5V$$

Conductance factor β of MOS transistor is proportional to the ratio W/L of gate width (channel width) W and gate length (channel length) L. To reduce variation in conductance factors β1 and β2 of MOS transistors Q1 and Q2 due to shape effect during manufacturing, MOS transistors Q1 and Q2 are preferably formed using unit MOS transistors having identical shapes and arranged in the same direction, as described as follows.

Figure 4A:
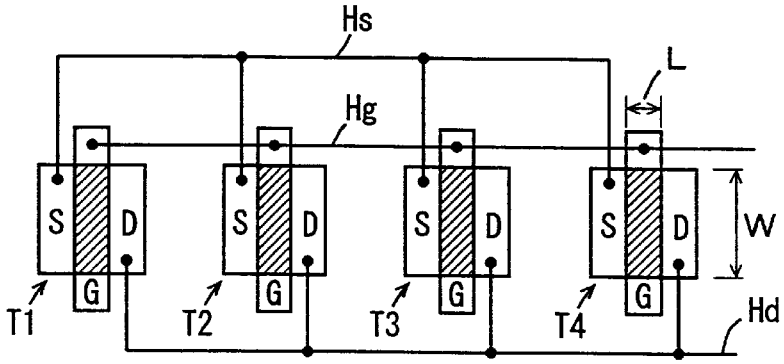
FIGS. 4A and 4B are diagrams schematically showing layout of an output MOS transistor.

FIG. 4A shows a layout for increasing the ratio of gate width and gate length of MOS transistor. In FIG. 4A, unit MOS transistors T1 to T4 each having the same shape and same ratio W/L are arranged in a horizontal direction. Each of unit MOS transistors T1 to T4 has a source region S, a gate electrode G, and a drain region D. In FIG. 4A, shaded area represents a channel region. Source regions S of respective unit MOS transistors T1 to T4 are interconnected via an interconnection line Hs, and their drain regions are interconnected via an interconnection line Hd. Gate electrodes G of unit MOS transistors T1 to T4 are interconnected via an interconnection line Hg. This configuration in which unit MOS transistors T1 to T4 are connected in parallel with each other is equivalent to a MOS transistor having a channel width 4W.

Figure 4B:
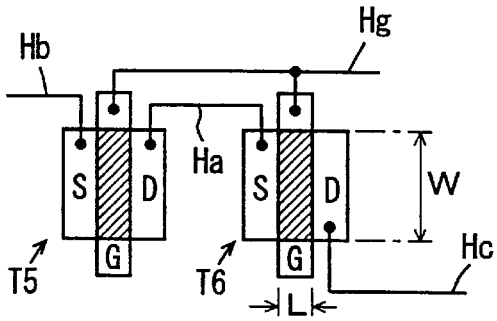

FIG. 4B shows interconnection for reducing ratio W/L. In FIG. 4B, unit MOS transistors T5 and T6 are arranged in parallel with each other. Unit MOS transistors T5 and T6 each have the same shape and same ratio W/L. Drain region D of unit MOS transistor T5 and source region S of unit MOS transistor T6 are interconnected via an interconnection line Ha. Gate electrodes G of unit MOS transistors T5 and T6 are interconnected via interconnection line Hg. Source region S of unit MOS transistor T5 is connected with an interconnection line Hb, and drain region D of unit MOS transistor T6 is connected with an interconnection line Hc.

In the case of the configuration shown in FIG. 4B, unit MOS transistors T5 and T6 are connected in series. Therefore, the configuration shown in FIG. 4B is equivalent to a MOS transistor having a channel length 2L.

Figure 5:
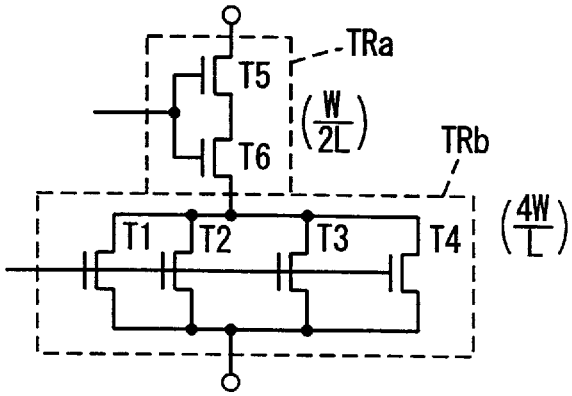
FIG. 5 is a diagram showing an electrically equivalent circuit of the unit MOS transistor shown in FIGS. 4A and 4B.

FIG. 5 shows an electrically equivalent circuit in the case where unit MOS transistors shown in FIGS. 4A and 4B are interconnected. In FIG. 5, MOS transistors TRa and TRb are connected in series. MOS transistor TRa having the configuration as shown in FIG. 4B is formed of unit MOS transistors T5 and T6 connected in series. MOS transistor TRb having the configuration shown in FIG. 4A is formed of unit MOS transistors T1 to T4 connected in parallel. MOS transistor TRa is adapted to have a gate width that is the same as gate width W of unit MOS transistor, and a channel length that is twice the channel length L of unit MOS transistor.

MOS transistor TRb is adapted to have its gate width that is four times the gate width W of unit MOS transistor, and a channel length that is equal to that of unit MOS transistor. That is, the ratio of gate width (channel width) to channel length (gate length) of MOS transistor TRa is given by W/2 L, and the ratio of channel width (gate width) to channel length (gate length) of MOS transistor TRb is given by 4 W/L.

As explained above, forming a MOS transistor using a plurality of unit MOS transistors makes it possible to reduce variation in conductance factors β1 and β2 due to deviation in a manufacturing parameter, compared with the case where a single MOS transistor is used. The configuration in which a MOS transistor is implemented using unit MOS transistors also has the following advantages.

Figure 6:
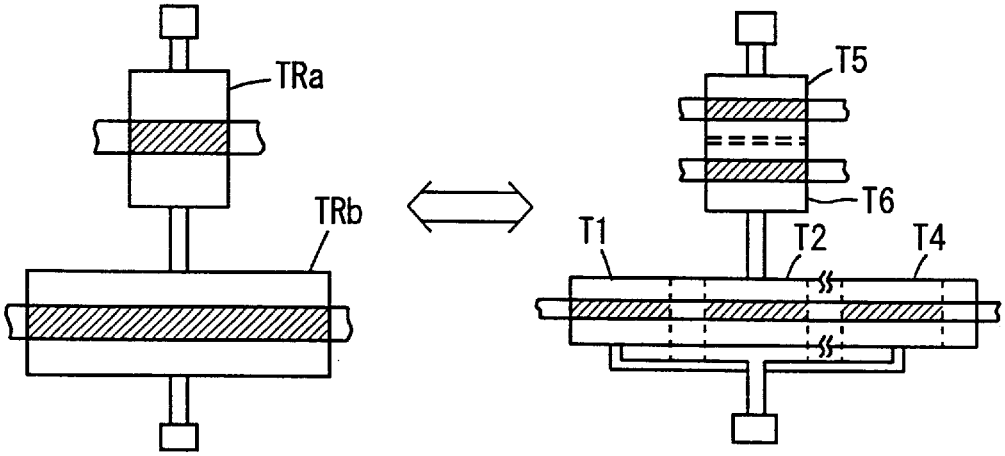
FIG. 6 is a diagram showing another layout of the output MOS transistor.

In a MOS transistor, there are known effects in relation to its gate width and gate length, such as a narrow channel effect and a short channel effect. The short channel effect causes an absolute value of threshold voltage to decrease, while the narrow channel effect causes the absolute value to increase. Therefore, if a channel length is shortened or a gate width is narrowed to implement desired gate width and gate length, the above effects will appear, hindering implementation of desired threshold voltage. Using unit MOS transistors, however, can eliminate these shape effects of MOS transistor, such as short channel effect and narrow channel effect, and, a desired threshold voltage can be implemented with accuracy. FIG. 6 shows another layout of unit MOS transistors. In FIG. 6, MOS transistor TRa is formed of two unit MOS transistors T5 and T6 that are arranged in a vertical direction. MOS transistor TRb is formed of unit MOS transistors T1 to T4 that are arranged in a horizontal direction. The configuration shown in FIG. 6 can also achieve the similar effects as above. That is, by using respective groups of unit MOS transistors having identical shapes and arranged in the same direction for MOS transistors Q1 and Q2, the shape effects can be suppressed, and variation in conductance factors β1 and β2 due to a manufacturing parameter can also be made small according to the following reason.

In the case where channel width and/or channel length is changed due to mask misalignment during manufacturing, the effects on conductance factor β are remarkable if one MOS transistor is being used.

For example, if the ratio W/L is 40, a slight change in channel length L will lead to a great change in conductance factor β. In contrast, when ratio W/L of unit MOS transistor is set at a small value, this mask misalignment is small, which is substantially negligible. Therefore, using a plurality of unit MOS transistors can eliminate effects due to parameter fluctuation during manufacturing, and suppress variation in conductance factors β1 and β2.

In addition, according to Japanese Patent Laying-Open No. 2-245810, it is preferable for a MOS transistor used in the reference voltage generating circuit as shown in FIGS. 1 to 3 to have a relatively long channel length, because of the reasons stated below. Specifically, MOS transistors having channel lengths of at least 5 $\mu$m, for example, are preferably used in the reference voltage generating circuit shown in FIGS. 1 to 3, when MOS transistors having channel lengths of the order of 1 $\mu$m are used in other circuit portions of the semiconductor device. For simplicity, in the above equations (10) to (13A), it is assumed that drain current IDS in the saturation region of MOS transistor depends only on the gate to source voltage. In practice, however, drain current IDS changes according to a drain to source voltage to some extent. Generally, drain current IDS is given by the following equation, if a width of a depletion layer between a channel and a drain is expressed as LD.

$$IDS=IDsat\cdot L/(L-LD)$$

where IDsat represents a saturated drain current, and L represents a channel length. Parameter LD depends on drain voltage VD of MOS transistor. Therefore, from the above equation, as the channel length L is longer, effects due to this parameter LD is reduced, and drain current IDS can be kept constant. It is generally known that drain conductance gd (=dIDS/dVG (VD: constant)) is larger as the channel length is shorter. Thus, drain conductance gd can be made smaller by lengthening this channel length L, to obtain more stable reference voltage Vo. Note that longer channel length L is also advantageous for suppressing fluctuation of a threshold voltage due to the short channel effect.

In the reference voltage generating circuit shown in FIGS. 1 to 3, backgates of MOS transistors Q1, Q2 and Q8 may be connected to their respective sources or to a common substrate terminal. However, since the threshold voltage of MOS transistor changes according to the voltage between backgate and source, it is preferable that MOS transistors Q1, Q2 and others have respective backgates connected to corresponding sources, as shown in FIG. 3, to avoid such backgate effect.

In gate control circuit 10, resistance element R7 is connected to ground node 4. However, it may be connected to a reference potential node that supplies a voltage of a constant voltage level lower than voltage V2 on node N2.

Negative voltage supplying node 22 is supplied with negative voltage −VB. This negative voltage −VB may be externally supplied, or a negative voltage generated within the semiconductor device may be utilized.

Figure 7:
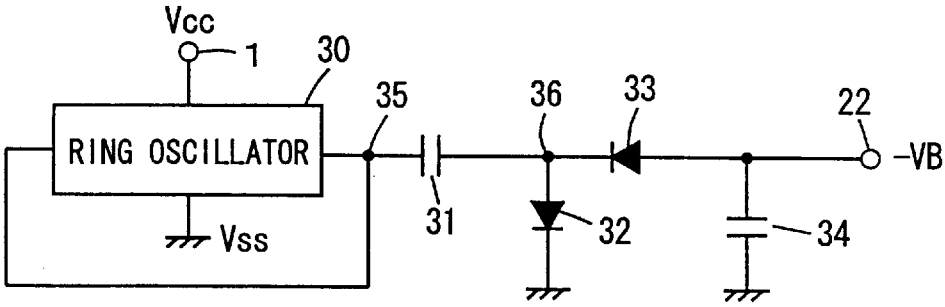
FIG. 7 is a diagram showing a configuration of the circuit for generating a negative voltage shown in FIG. 3.

FIG. 7 shows a configuration of a negative voltage generating circuit that generates negative voltage −VB within the semiconductor device. The negative voltage generating circuit shown in FIG. 7 is generally known as a circuit for generating a substrate bias VBB of a dynamic type RAM.

Referring to FIG. 7, the negative voltage generating circuit includes: a ring oscillator 30 that operates using power supply voltage Vcc supplied to power supply node 1 and ground voltage Vss supplied to the ground node as both operating power supply voltages for generating a pulse signal having constant period and pulse width; a capacitor 31 provided between an output node 35 of ring oscillator 30 and a node 36 for effecting charge pumping operation according to the pulse signal from ring oscillator 30; a diode element 32 provided between node 36 and a ground node for clamping node 36 at a prescribed voltage; a diode element 33 connected in a backward direction between node 36 and negative voltage node 22; and a stabilizing capacitor 34 for stabilizing the voltage of node 22. Diode elements 32 and 33 each may be composed using a MOS transistor having its drain and gate interconnected. Ring oscillator 30 is composed, for example, of an odd number of stages of cascaded inverter circuits. Now, the operation of negative voltage generating circuit shown in FIG. 7 will be described in brief.

The pulse signal from ring oscillator 30 is supplied to node 35. The change in signal level at node 35 is transmitted to node 36 via capacitor 31. When the voltage on node 35 increases and the voltage on node 36 increases in response, diode element 32 discharges the voltage on node 36, and the voltage level of node 36 is clamped to a forward voltage drop VS of diode element 32. The voltage level of node 22 is 0V or below, and diode element 33 is in an OFF state.

When the pulse signal from ring oscillator 30 falls to an L level and the voltage on node 35 is lowered from the H level to an L level, the voltage change on node 35 in the negative direction is transmitted to node 36 via capacitor 31, and the voltage of node 36 decreases. Accordingly, diode element 32 attains an OFF state, and diode element 33 is turned ON. Negative charges are transmitted from node 36 to node 22 (i.e., one electrode of stabilizing capacitor 34). If voltage V22 of node 22 is higher than voltage V36 of node 36 by at least forward voltage drop VS of diode element 33, diode element 33 is turned OFF. In one oscillation cycle of ring oscillator 30, the voltage level of negative voltage supplying node 22 decreases by a voltage that is equivalent to the capacitance ratio between capacitors 31 and 34 (typically 10 to 100). Repeating the above operation, the voltage level of negative voltage supplying node 22 ultimately attains a fixed negative voltage expressed by the following equation.

$$-VB.=-(Vcc-2\cdot VS)$$

As described above, in the reference voltage generating circuit, the current flowing through resistance element 24 is small (only a minute current flows through MOS transistor Q8 shown in FIG. 3 to realize clamping operation of this MOS transistor Q8.). Therefore, the negative voltage generating circuit shown in FIG. 7 need not have large current supplying capability, and the one having a small area can be utilized. When this reference voltage generating circuit is applied to a dynamic type RAM, it may be configured to use a negative voltage from the negative voltage generating circuit that is used for generating a substrate bias in the dynamic type RAM. Besides dynamic type RAM, as long as a circuit for generating a negative voltage is provided on the same substrate, that negative voltage may be utilized.

As explained above, according to the second embodiment of the present invention, the gate of an enhancement type MOS transistor for discharging an output node is supplied with a voltage of the second power supply node or the ground node shifted by the threshold voltage. Thus, power supply voltage dependency of the output voltage from the output node can be eliminated, and accordingly, the output voltage at a stable, desired voltage level can be obtained independent of fluctuation in operating environment (temperature and operating power supply voltage) and in manufacturing parameter.

Third Embodiment

Figure 8:
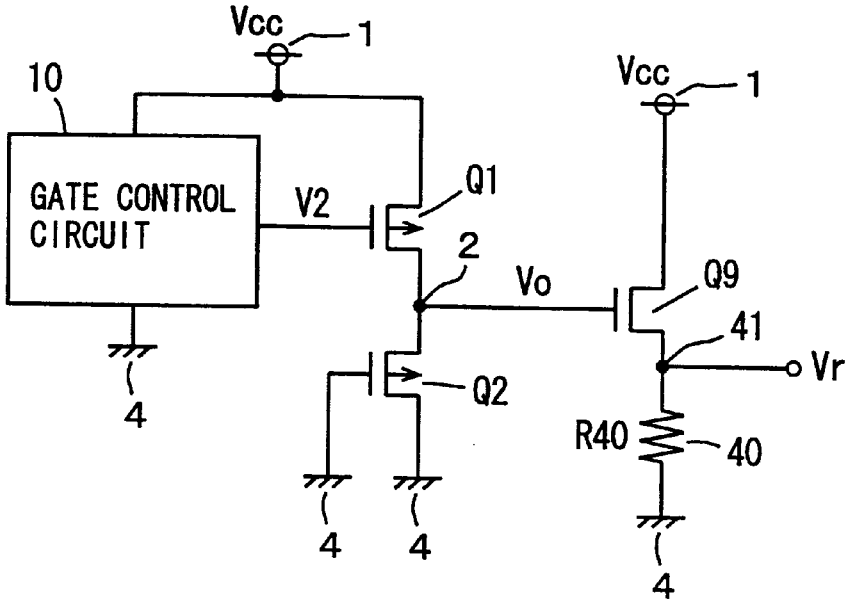
FIG. 8 is a diagram showing a configuration of a reference voltage generating circuit according to a third embodiment of the present invention.

FIG. 8 shows a configuration of a reference voltage generating circuit according to the third embodiment of the present invention. The reference voltage generating circuit shown in FIG. 8 includes, in addition to those in the configuration of the reference voltage generating circuit shown in FIG. 1 or 2, an enhancement type n channel MOS transistor Q9 for supplying a current from power supply node 1 to a second output node 41 according to the output voltage Vo, and a resistance element 40 of high resistance that is connected between node 41 and ground node 4. The voltage Vr from the second output node 41 is used as a reference voltage in a succeeding circuit. Resistance element 40 has a pull-down function to prevent increase of the voltage level of voltage Vr from output node 41. Now, the operation of the reference voltage generating circuit shown in FIG. 8 will be described.

Resistance value R40 of resistance element 40 is set sufficiently larger than ON resistance of MOS transistor Q9, and MOS transistor Q9 operates in a source follower mode. Therefore, voltage Vr from the second output node 41 is expressed by the following equation.

$$Vr = Vo - VTN \tag{14}$$

$$= (\beta 1/\beta 2)^{1/2}(VTP1 - VTP) - VTP2 - VTN$$

where VTN represents a threshold voltage of MOS transistor Q9. The p channel MOS transistor included in gate control circuit 10 has an equal threshold voltage VTP.

Figure 33:
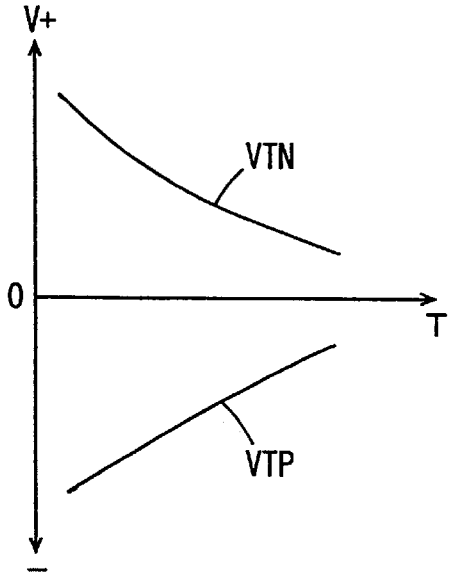
FIG. 33 PRIOR ART
FIG. 33 is a graph illustrating temperature dependency of the threshold voltage of a conventional MOS transistor.

In the above equation (14), a difference of the threshold voltages is obtained in the first term, and the temperature dependencies of these threshold voltages are canceled. The second and third terms give the sum of threshold voltages. As shown in FIG. 33, however, threshold voltage VTN of n channel MOS transistor and threshold voltage VTP of p channel MOS transistor have the same temperature dependency in absolute value. Therefore, (VTP2+VTN)=(VTN−|VTP2|), and thus, the temperature dependencies of these threshold voltages are canceled. Accordingly, the voltage Vr expressed by equation (14) can be kept at a fixed voltage level regardless of operating temperature. Voltage Vr, like output voltage Vo, does not have dependency on power supply voltage Vcc. Thus, voltage Vr is kept at a constant voltage level independent of operating environment.

MOS transistor Q9 attains an ON state when voltage Vr is (Vo−VTN) or below, to supply a current from power supply node 1 to node 41. When gate to source voltage (Vo−Vr) of MOS transistor Q9 is smaller than threshold voltage VTN of MOS transistor Q9, MOS transistor Q9 is turned OFF. If voltage Vr becomes higher than a prescribed voltage level due to noise, for example, resistance element 40 of high resistance discharges node toward the ground voltage level. Thus, voltage Vr is prevented from being kept at a level higher than the prescribed voltage level for a long period of time.

Since MOS transistor Q9 operates in the boundary region between ON and OFF states, current dissipation of MOS transistor Q9 can also be made sufficiently small.

Note that, in the reference voltage generating circuit shown in FIG. 8, voltage Vr from node 41 can be utilized as an operating power supply voltage if the current drivability of MOS transistor Q9 is made sufficiently large.

As explained above, according to the third embodiment of the present invention, the output voltage of output transistor formed of a p channel MOS transistor is received by a gate and transmitted in a source follower mode. Accordingly, a circuit configuration for biasing the gate voltage of the output node discharging MOS transistor to a negative voltage is unnecessary. Thus, temperature dependency can easily be canceled with a simple circuit configuration, and the output voltage can be kept at a constant voltage level independent of operating environment.

Fourth Embodiment

Figure 9:
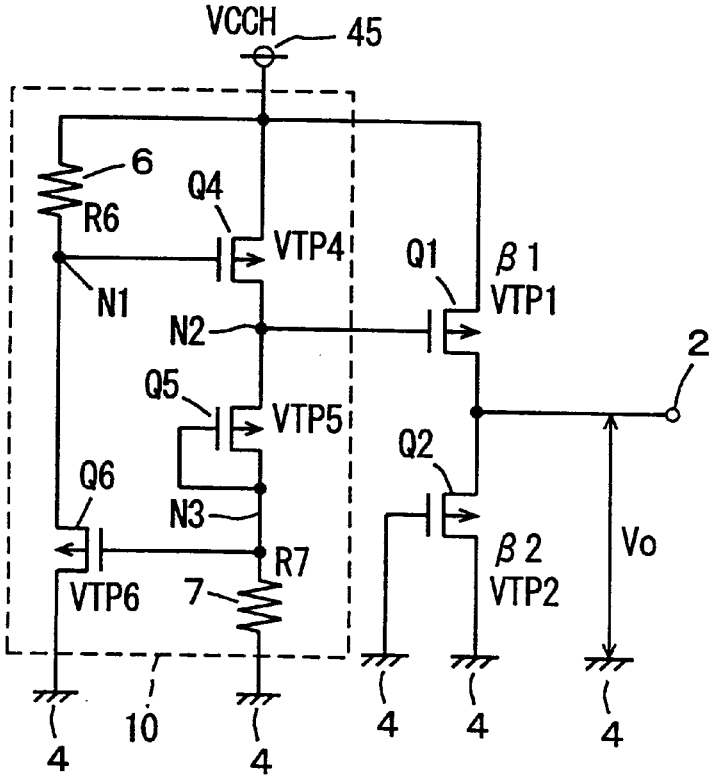
FIG. 9 is a diagram showing a configuration of a reference voltage generating circuit according to a fourth embodiment of the present invention.

FIG. 9 shows a configuration of a reference voltage generating circuit according to the fourth embodiment of the present invention. In the reference voltage generating circuit shown in FIG. 9, a high voltage VCCH is supplied to a power supply node 45 as an operating power supply voltage. This high voltage VCCH is a voltage higher than power supply voltage Vcc. Other configuration is identical to that shown in FIG. 1, and corresponding portions are designated by same reference characters and description thereof is not repeated.

For stable operation of gate control circuit 10, MOS transistors Q4, Q5 and Q6 should be held at an ON state reliably. MOS transistor Q6 operates in a source follower mode and MOS transistor Q5 in a diode mode. In the case where these MOS transistors Q6 and Q5 have the same threshold voltage VTP, the voltage levels of nodes N1 and N2 are equal. Therefore, to ensure stable operation of gate control circuit 10, the power supply voltage level needs to be set at least the sum of the voltage drop amount (VTP) at MOS transistor Q4, voltage drop amount (VTP) of MOS transistor Q5 and voltage drop amount of resistance element R7. If the voltage level of power supply voltage Vcc is decreased due to reduced power supply voltage arrangement, for example, the difference between power supply voltage Vcc and a voltage (2|VTP|+Δ) at which gate control circuit 10 can stably operate decreases. Stable operation of gate control circuit 10 thus becomes difficult, hindering stable generation of the output voltage. In view of the foregoing, high voltage VCCH is supplied to power supply node 45 to enable gate control circuit 10 to operate stably. Accordingly, output voltage Vo at a stable, prescribed voltage level can be generated even with a low power supply voltage. In particular, in gate control circuit 10, resistance values of resistance elements 6 and 7 can be made sufficiently large, e.g., 100MΩ. Output MOS transistors Q1 and Q2 are required only of generating the voltage, and thus, current drivability is not required for them. What is needed is simply to set the ratio of conductance factors (βratio) at a desired level. A large current flow through these MOS transistors Q1 and Q2 is not necessary. Accordingly, even when high voltage VCCH is utilized as one operating power supply voltage of this reference voltage generating circuit, the high voltage generating circuit is not needed of a large current supplying capability. It is possible to use a high voltage generating circuit occupying a small area to stably operate the reference voltage generating circuit.

Modification

Figure 10:
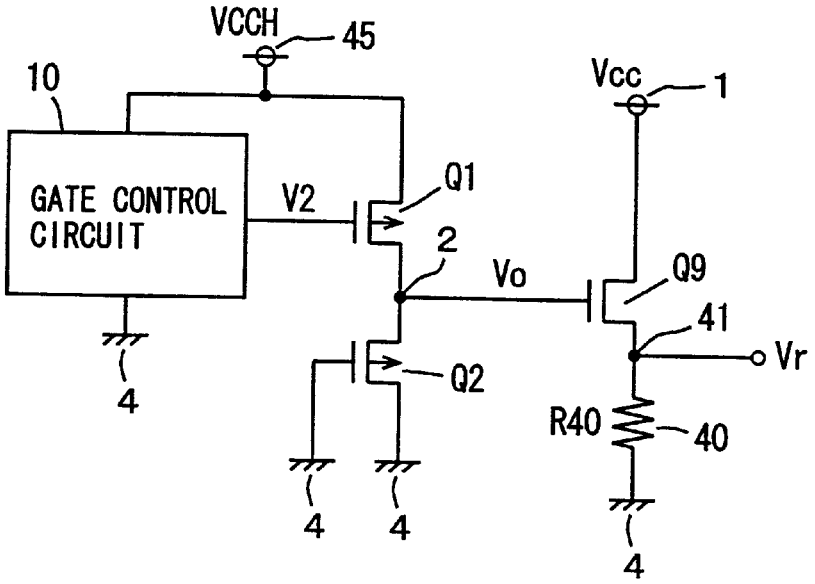
FIG. 10 is a diagram showing a configuration of a modification of the fourth embodiment of the present invention.

FIG. 10 shows a configuration of a modification of the fourth embodiment of the present invention. The configuration shown in FIG. 10 differs from that of FIG. 8 in that high voltage VCCH from a high voltage supplying node 45 is supplied to gate control circuit 10 and to output MOS transistor Q1. Other configuration is identical to that shown in FIG. 8, and the same portions are denoted by the same reference numbers.

In the reference voltage generating circuit shown in FIG. 10, it is necessary to set the voltage Vo output from MOS transistor Q1 higher than in the case of the circuit configuration shown in FIG. 9 by threshold voltage VTN of MOS transistor Q9. When threshold voltages of all the MOS transistors included in gate control circuit 10 are made equal to VTP, output voltage V2 of gate control circuit 10 becomes Vcc+VTP (see equation (6)). Therefore, when output voltage Vo must be set higher by the threshold voltage VTN of MOS transistor Q9, lower limit condition of power supply voltage Vcc becomes more strict by this threshold voltage VTN. By using high voltage VCCH instead of power supply voltage Vcc, it becomes possible to generate a stable reference voltage Vr at a prescribed voltage level even in a configuration in which reference voltage Vr is generated using MOS transistor Q9 operating in a source follower mode.

The configuration utilizing this high voltage VCCH as its one operating power supply voltage may be utilized in the configurations shown in FIGS. 2 and 3.

Figure 11:
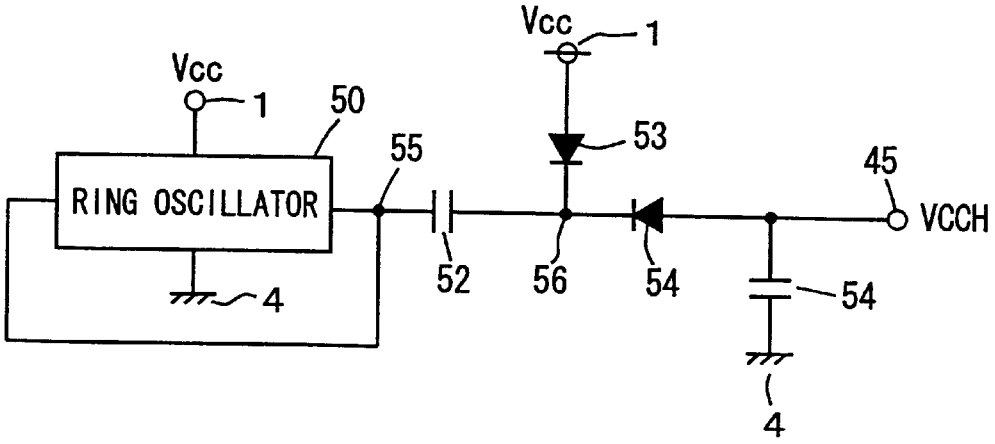
FIG. 11 is a diagram showing a configuration of the circuit for generating a high voltage shown in FIGS. 9 and 10.

FIG. 11 shows an exemplary configuration of a circuit generating high voltage VCCH within the semiconductor device. The high voltage generating circuit shown in FIG. 11 is generally used when a high voltage that is higher than the power supply voltage is generated by utilizing charge pumping operation of capacitor.

Referring to FIG. 11, the high voltage generating circuit includes: a ring oscillator 50 that operates using power supply voltage Vcc of power supply node 1 and ground voltage Vss of ground node 4 as its operating power supply voltages for generating a pulse signal having prescribed pulse width and period; a capacitor 52 connected between nodes 55 and 56 for transmitting voltage change in node 55 to node 54 by charge pumping operation; a diode element 53 connected between power supply node 1 and node 56; a diode element 54 connected between nodes 56 and 45; and a stabilizing capacitor 54 for stabilizing the voltage of node 45. Diode element 53 has its anode connected to power supply node 1 and its cathode connected to node 56. Diode element 54 has its anode connected to node 56 and its cathode connected to node 45. Ring oscillator 50 is formed, e.g., of an odd number of stages of cascaded inverter circuits. Diode elements 53 and 54 may be formed of MOS transistors. Now, the operation of the high voltage generating circuit shown in FIG. 11 will be described in brief.

When the pulse signal output from ring oscillator 50 drops from an H level to an L level, the voltage change of the signal on node 55 is transmitted to node 54. Though the voltage of node 56 decreases according to the voltage drop of node 55, it is charged by diode element 53, and node 56 is clamped to the voltage level of voltage Vcc−VS. Here, VS represents a forward voltage drop of diode element 53. Diode element 54 is in an OFF state since the voltage of node 45 is higher than that of node 56.

When the pulse signal transmitted from ring oscillator 50 to node 55 rises from the L level to the H level, the voltage of node 56 is further raised by the voltage level of power supply voltage Vcc due to capacitive coupling of capacitor 52. This voltage increase of node 56 causes diode element 54 to turn ON, a current to flow from node 56 to node 45, and the voltage level of node 45 to increase according to the capacitance ratio (typically 10 to 100) of capacitor 52 and stabilizing capacitor 54. When the voltage difference between nodes 56 and 45 is equal to forward voltage drop VS of diode element 54, diode element 54 is turned OFF. By repeating this operation, ultimately, the voltage level of high voltage VCCH of node 45 reaches a voltage level that is expressed by the following equation.

$$VCCH=2\cdot Vcc-2\cdot VS$$

If Vcc=5V and VS=0.7V, high voltage VCCH is 8.6V, which is a voltage level sufficiently higher than power supply voltage Vcc. The current dissipated by this reference voltage generating circuit is extremely small. Accordingly, the high voltage generating circuit only needs a small current drivability, and its occupying area can be made sufficiently small.

As a circuit for generating this high voltage VCCH, a boosting circuit used for generating a word line boosted signal or the like may be used in a dynamic type semiconductor memory device. That is, any circuit provided for internally generating a high voltage within the semiconductor device may be utilized.

As explained above, according to the fourth embodiment of the present invention, a high voltage that is higher than the power supply voltage is used as one operating power supply voltage of the reference voltage generating circuit. Thus, a stable reference voltage of prescribed voltage level can be generated even under the condition of low power supply voltage.

Fifth Embodiment

Figure 12:
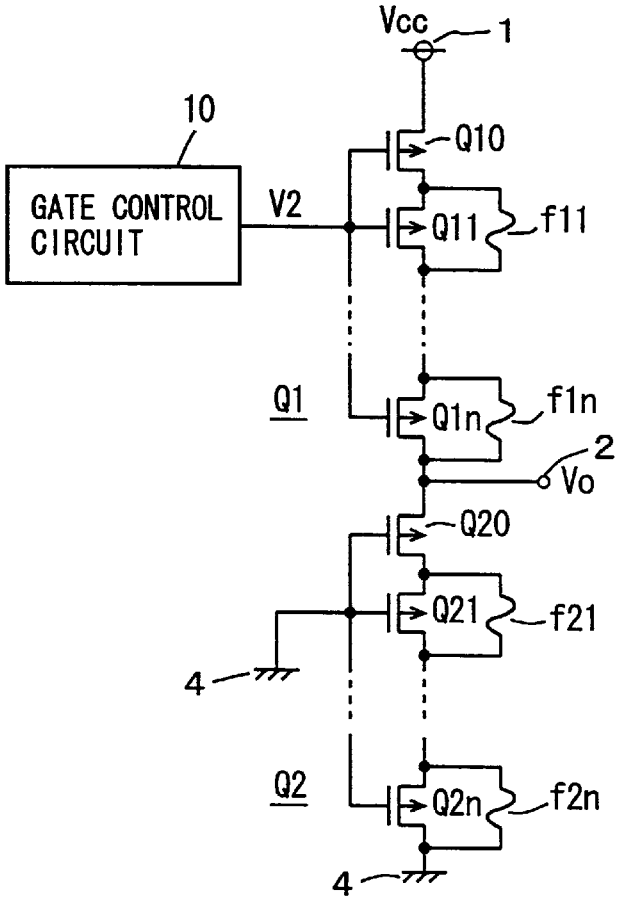
FIG. 12 is a diagram schematically showing a configuration of a reference voltage generating circuit according to a fifth embodiment of the present invention.

FIG. 12 shows a configuration of a reference voltage generating circuit according to the fifth embodiment of the present invention. In the configuration shown in FIG. 12, conductance factors β1 and β2 of respective output transistors Q1 and Q2 can be trimmed. Output MOS transistor Q1 includes p channel MOS transistors Q10–Q1n connected in series between power supply node 1 and output node 2, and fusible link elements f11-f1n connected in parallel with MOS transistors Q11–Q1n. Output transistor Q2 includes p channel MOS transistors Q20–Q2n connected in series between output node 2 and ground node 4, and fusible link elements f21–f2n connected in parallel with MOS transistors Q21–Q2n.

Each of link elements f11–f1n and f21–f2n is formed of a fuse element using polysilicon or the like, and is fusible by laser beam. Link elements f11–f1n and f21–f2n short-circuit corresponding MOS transistors QI1–Q1n and Q21–Q2n when made conductive.

In output MOS transistor Q1, when link elements f11–f1n are all conductive, p channel MOS transistor Q10 is connected between power supply node 1 and output node 2. Therefore, in this case, conductance factor β1 of output transistor Q1 is given by β0·(WL). Here, β0 is a current amplifying factor (a constant given by a product of a capacitance value of gate capacitance and mobility of an electron) of MOS transistors Q10–Q1n, and W and L each represent channel width and channel length of MOS transistors Q10–Q1n.

If an appropriate number of link elements f11–f1n are blown off, a desired number of p channel MOS transistors are connected in series between power supply node 1 and output node 2, and channel length of this output MOS transistor Q1 is lengthened. Thus, conductance factor β1 of output MOS transistor Q1 can be set at a desired value by blowing off a proper number of link elements f11–f1n (as the number of link elements to be blown off increases, the equivalent channel length is lengthened, and conductance factor β1 of output MOS transistor Q1 is decreased).

Similarly, in the case of output MOS transistor Q2, an appropriate number of link elements f21–f2n are blown off to decrease the value of conductance factor β2 of output MOS transistor Q2. As shown previously in equation (13), output voltage Vo depends on a square root of ratio of conductance factors β1/β2. Therefore, if conductance factor β1 of output transistor Q1 is made small, the voltage level of output voltage Vo can be reduced. Conversely, if conductance factor β2 of output MOS transistor Q2 is made small, the voltage level of output voltage Vo can be increased. Accordingly, it becomes possible to set output voltage Vo to a prescribed voltage level in the case where the voltage level of output voltage Vo deviates from the prescribed value due to variation in manufacturing parameter or the like.

Note that MOS transistors Q10–Q1n and Q20–Q2n may be configured using unit MOS transistors as shown in FIG. 4B. Respective MOS transistors Q10–Q1n may differ in size (the ratio between channel width and channel length) from each other. The same can be said with MOS transistors Q20–Q2n. Link elements are not provided for MOS transistors Q10 and Q20, to define the maximum conductance factor values of respective output MOS transistors Q1 and Q2, and to prevent short-circuit between power supply node 1 and output node 2, and between output node 2 and ground node 4. Before the fuse blow process, link elements f11–f1n and f21–f2n are all in a conductive state. Thus, a large current flows from power supply node 1 to ground node 4 through these link elements after power on, to cause destruction of elements. Transistors Q10 and Q20 prevent such destruction.

Modification

Figure 13:
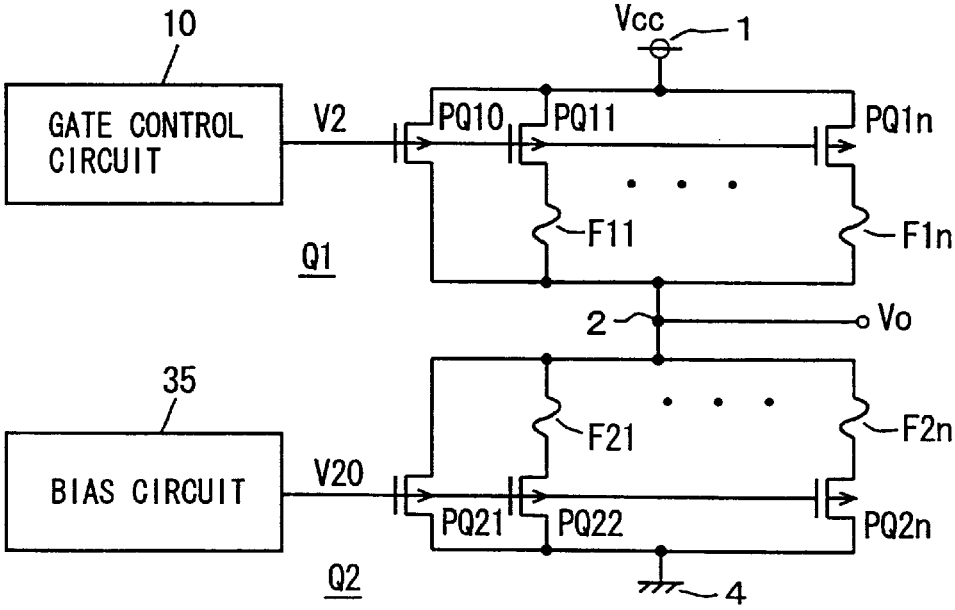
FIG. 13 is a diagram showing a modification of the fifth embodiment of the present invention.

FIG. 13 shows a configuration of a modification of the fifth embodiment of the present invention. Referring to FIG. 13, output transistor Q1 includes p channel MOS transistors PQ10–PQ1n connected in parallel with each other, and fusible link elements f11–f1n connected in series with respective MOS transistors PQ11–PQ1n. MOS transistors PQ10–PQ1n have their gates receiving voltage V2 from gate control circuit 10. MOS transistor PQ10 has its source connected to power supply node 1, and its drain connected to output node 2. MOS transistors PQ11–PQ1n each have its source connected to power supply node 1, and its drain connected to output node 2 via corresponding link element f11–f1n.

Output MOS transistor Q2 includes p channel MOS transistors PQ21–PQ2n connected in parallel with each other, and fusible link elements f21–f2n connected in series with MOS transistors PQ21–PQ2n. MOS transistor PQ21 has its source connected to output node 2, and its drain connected to ground node 4. MOS transistors PQ22–PQ2n have respective drains connected to ground node 4, and respective sources coupled to output node 2 via corresponding link elements f21–f2n. The gates of these MOS transistors PQ21–PQ2n receive bias voltage V2 from bias circuit 35.

Link elements f11–f1n and f21–f2n are each formed of a fuse element using polysilicon, for example, and is fusible by laser or electron beam.

In output MOS transistor Q1, the number of p channel MOS transistors to be connected between power supply node 1 and output node 2 is reduced by blowing off link elements f11–f1n, and in response, channel width W1 of output MOS transistor Q1 decreases. Conductance factor $\beta 1$ of output MOS transistor Q1 becomes smaller as the number of link elements f11–f1n to be blown off increases.

Similarly, in the case of output MOS transistor Q2, its conductance factor $\beta 2$ becomes smaller as the number of blown off link elements f21–f2n increases. Since output voltage Vo depends on conductance factor ratio $\beta 1/\beta 2$, output voltage Vo can be set to a prescribed voltage level by blowing off these link elements f11–f1n and f21–f2n. Further, in the configuration shown in FIG. 13, MOS transistors PQ10 and PQ21 are not connected with link elements. This is to define the minimum channel width of output MOS transistors Q1 and Q2. However, link elements may be connected to respective MOS transistors PQ10 and PQ21.

In the configuration shown in FIG. 12, output voltage V2 from bias circuit 35 may be supplied to the gate of output MOS transistor Q2, as shown in FIG. 13. Further, in the configuration shown in FIG. 13, the gate of output MOS transistor Q2 may be connected to ground node 4.

Moreover, in the configurations shown in FIGS. 12 and 13, gate control circuit 10 may be supplied with power supply voltage Vcc or high voltage VCCH. Output MOS transistor Q1 may be configured to receive the high voltage VCCH in the configurations shown in FIGS. 12 and 13.

The configurations shown in FIGS. 12 and 13, which enable trimming of conductance factors of output MOS transistors, may be used in combination with the configurations shown in FIGS. 8 to 10.

MOS transistors PQ10–PQ1n and PQ21–PQ2n may be unit MOS transistors as shown in FIG. 4A, or, MOS transistors different in size (i.e., ratio between channel length and channel width) from each other.

As explained above, according to the fifth embodiment of the present invention, conductance factors of output MOS transistors can be trimmed. Thus, even when the voltage level of output voltage Vo deviates from a prescribed voltage level due to fluctuation of a manufacturing parameter, change in current amplifying ratio, and so on, it is possible to correct the deviation of output voltage Vo to obtain the output voltage at a correct, prescribed voltage level.

Sixth Embodiment

To generate output voltage Vo, it is necessary to realize at least two threshold voltages different in values from each other. Normally, adjustment of the threshold voltage of MOS transistor is performed by adjusting impurity concentration of the surface of the channel region. To realize different threshold voltages, individual ion implantation processes are needed for respective threshold voltages, which causes increase in the number of manufacturing steps of the semiconductor device. To prevent such increase in the number of manufacturing steps, the above-described reference voltage generating circuits utilizing the difference of threshold voltages can be made according to a manufacturing method described in the following.

Figure 14:
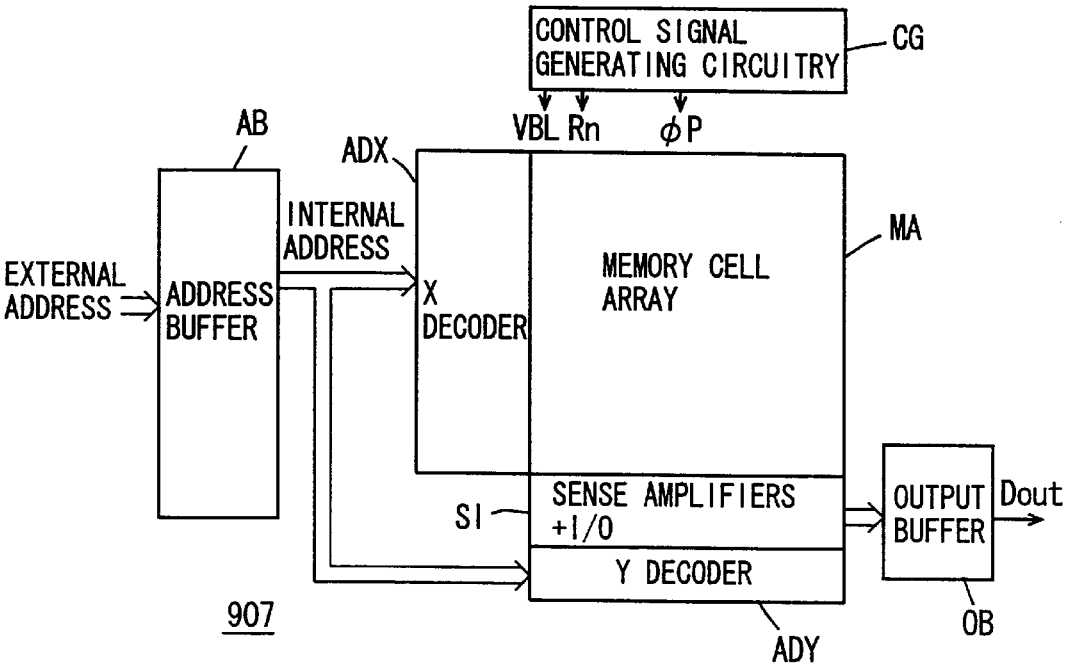
FIG. 14 is a diagram schematically showing a configuration of a semiconductor device including a reference voltage generating circuit according to the present invention.
Figure 29:
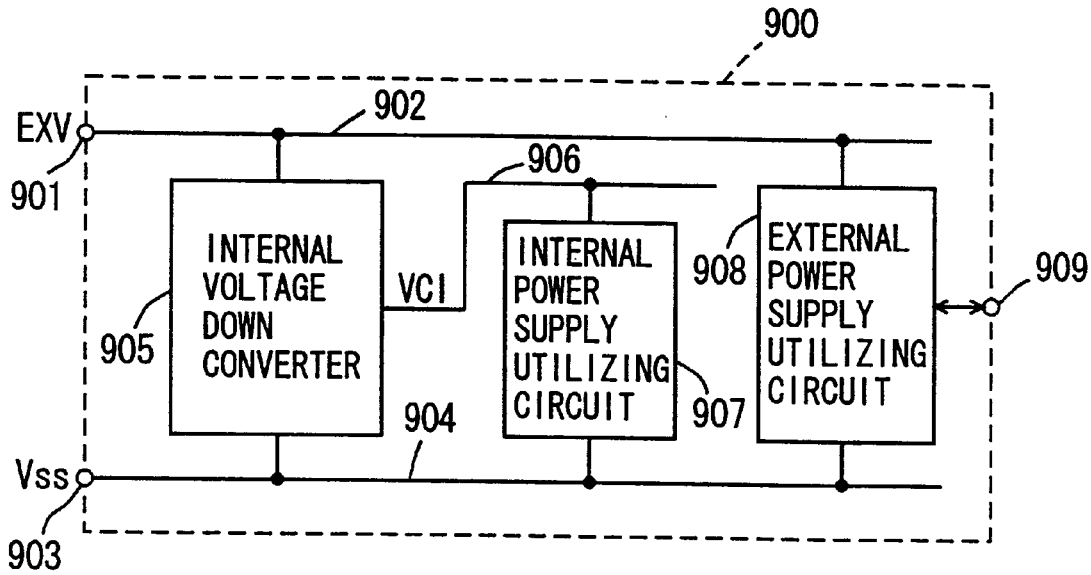
FIG. 29 PRIOR ART
FIG. 29 is a diagram schematically showing a configuration of a conventional semiconductor device.
Figure 30:
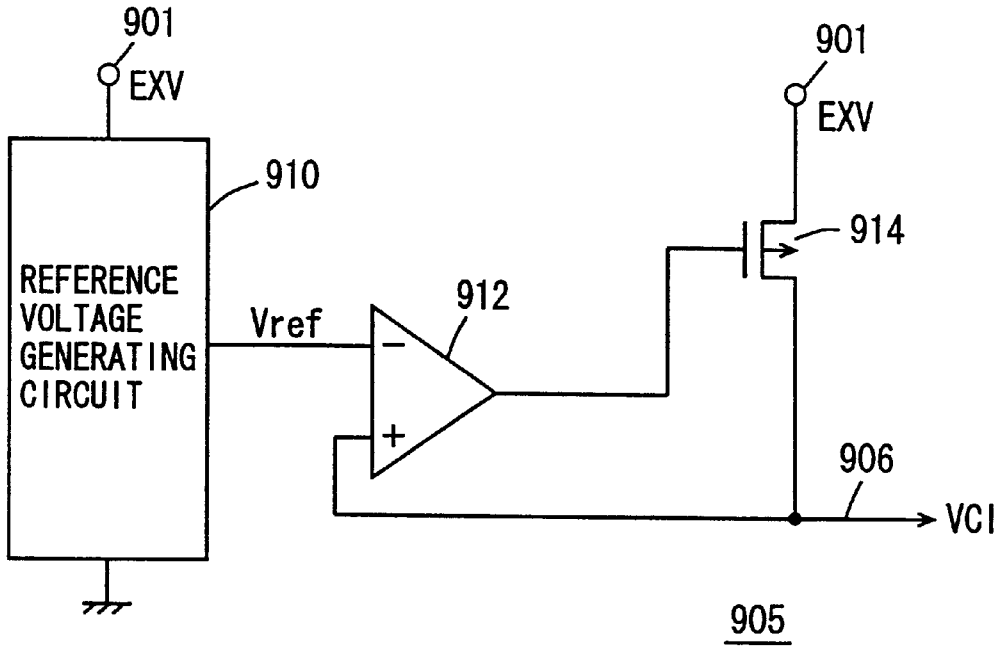
FIG. 30 PRIOR ART
FIG. 30 is a diagram schematically showing a configuration of the internal voltage down converter shown in FIG. 29.
Figure 31:
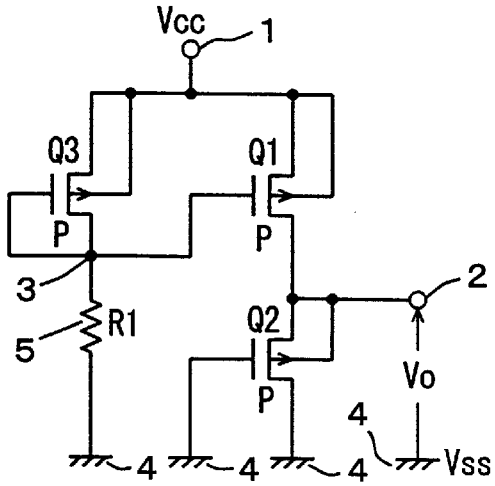
FIG. 31 PRIOR ART
FIG. 31 is a diagram showing a configuration of a conventional reference voltage generating circuit.
Figure 32:
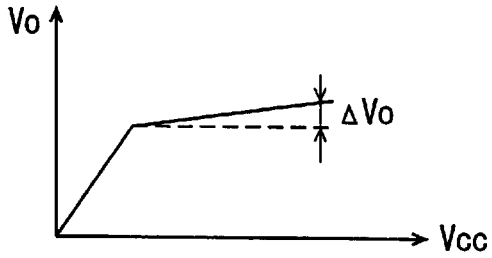
FIG. 32 PRIOR ART
FIG. 32 is a graph illustrating power supply voltage dependency of the output voltage of the reference voltage generating circuit shown in FIG. 31.

FIG. 14 schematically shows a configuration of the internal power supply utilizing circuit 907 shown in FIG. 29. In FIG. 14, internal power supply utilizing circuit 907 includes: a memory cell array MA having a plurality of memory cells arranged in a matrix of rows and columns; an address buffer AB for buffering an externally applied external address signal to generate an internal address signal; an X decoder ADX for decoding the internal address signal from address buffer AB to select a corresponding row in memory cell array MA; and a Y decoder ADY for decoding the internal address signal from address buffer AB to generate a column select signal for selecting a corresponding column in memory cell array MA.

Internal power supply utilizing circuit 907 further includes: sense amplifiers for sensing and amplifying data in memory cells that are connected to the row (word line) selected in memory cell array MA; and an I/O gate responsive to the column select signal from Y decoder ADY for connecting a corresponding column in memory cell array MA to an output buffer OB. In FIG. 14, the sense amplifiers and the I/O gate are expressed as a block SI.

Output buffer OB buffers internal read data transmitted from block SI to generate external read data Dout. The last output stage (a circuit portion connected to the external output terminal) of this output buffer OB uses the external power supply voltage to interface with an external device. In FIG. 14, output buffer OB is shown to use internal power supply voltage VCI. This is because the circuit portion other than the last output stage included in output buffer OB uses internal power supply voltage VCI.

Further, control signal generating circuitry CG for generating control signals to control various operation timings of internal power supply utilizing circuit 907 is provided as one of the peripheral circuits. The peripheral circuits may include address buffer AB, X decoder ADX, Y decoder ADY, and block SI.

Control signal generating circuitry CG generates a word line driving signal Rn that is transmitted onto a selected row (word line described later) of memory cell array MA, and a precharge designating signal $\phi p$ that designates precharging of internal nodes to a prescribed potential VBL in a standby cycle. Control signal generating circuitry CG is also shown to generate a precharge voltage VBL for precharging the internal nodes in the precharge cycle (standby cycle).

Figure 15:
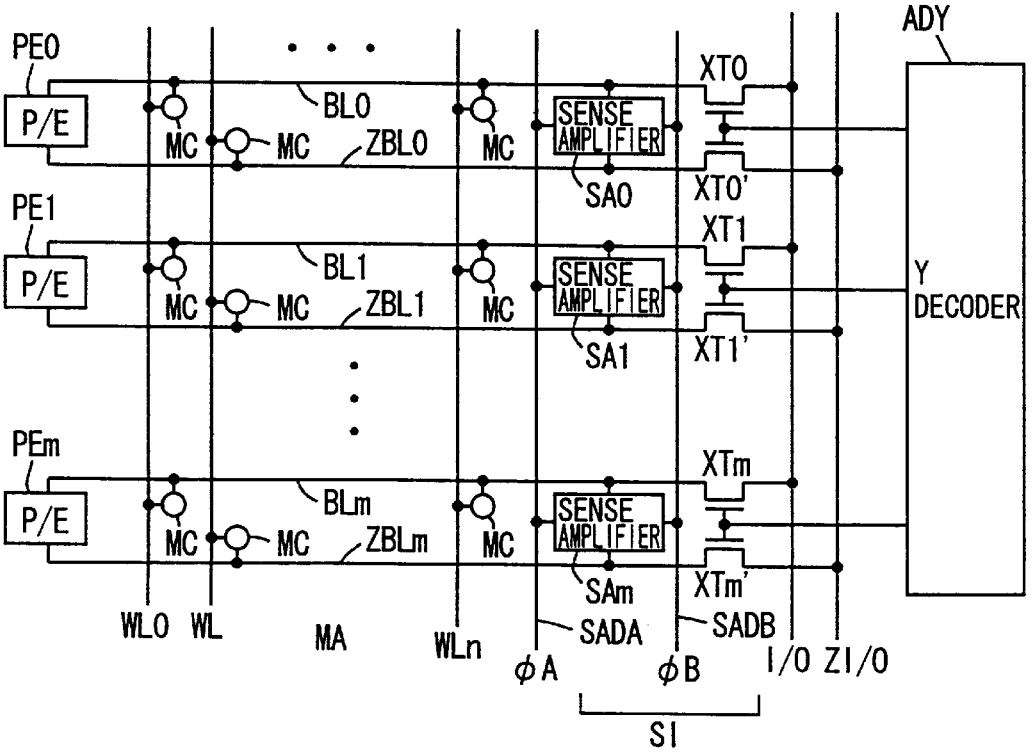
FIG. 15 is a diagram showing more specifically a configuration of the memory cell array shown in FIG. 14.

FIG. 15 schematically shows a configuration of memory cell array MA shown in FIG. 14. In FIG. 15, memory cell array MA includes: a plurality of memory cells MC arranged in a matrix of rows and columns; a plurality of word lines WL (WL0–WLn) disposed corresponding to respective rows of memory cells MC and each connected with memory cells MC in a corresponding row; and a plurality of bit line pairs BL, ZBL (BL0, ZBL0–BLm, ZBLm) disposed corresponding to respective columns of memory cells and each connected with memory cells MC in a corresponding column. Bit lines BL and ZBL are arranged in a pair, and transmit data signals complementary to each other. Memory cell MC is disposed at a crossing of a word line WL and a pair of bit lines BL and ZBL. For example, a memory cell MC is disposed at a crossing of word line WL0 and bit line BL0, and another memory cell MC is disposed at a crossing of word line WL1 and bit line ZBL0.

Precharge/equalize circuits (P/E) PE0–PEm are disposed corresponding to respective bit line pairs BL0, ZBL0–BLm, ZBLm, for precharging and equalizing corresponding bit line pairs BL, ZBL to a prescribed voltage VBL during a standby cycle (during precharge).

Block SI includes: sense amplifiers SA0–SAm disposed corresponding to respective bit line pairs BL0, ZBL0–BLm, ZBLm for differentially amplifying signal voltages of corresponding bit line pairs BL, ZBL when activated; and IO gates provided corresponding to respective bit line pairs BL0, ZLB0–BLm, ZBLm and selectively rendered conductive in response to a column select signal from Y decoder ADY for connecting corresponding bit line pairs BL, ZBL to internal data lines I/O, ZI/O. IO gate includes transfer gates XTi, XTi' disposed corresponding to a bit line pair BLi, ZBLi (i=0 to m).

Sense amplifiers SA0–SAm are activated in response to sense amplifier activation control signals ϕA and ϕB transmitted via sense amplifier activation signal lines SADA and SADB, respectively.

Figure 16:
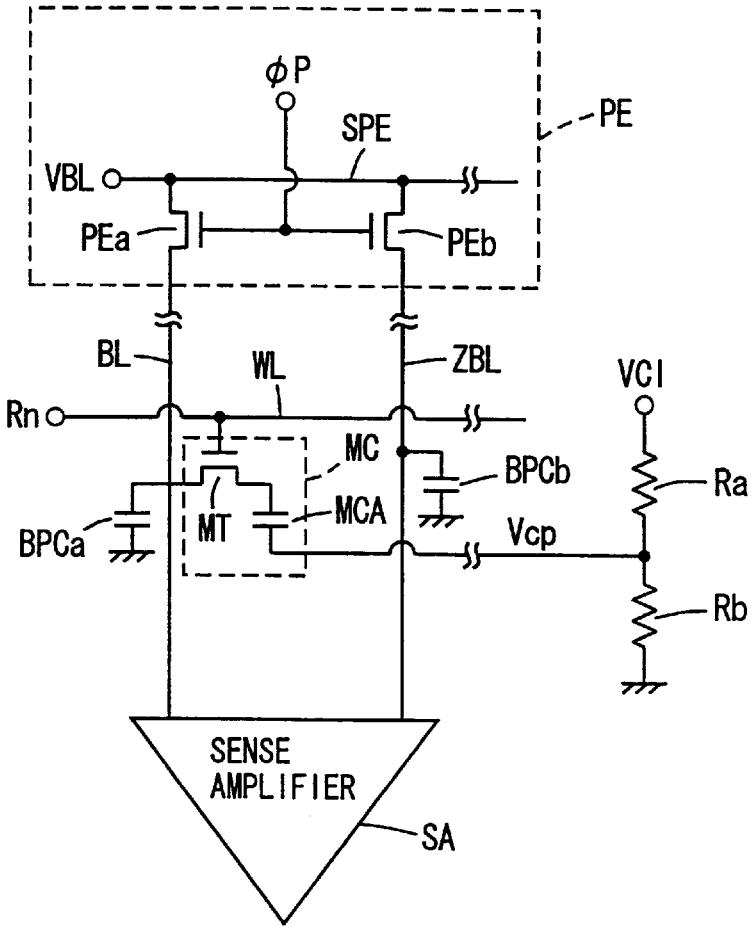
FIG. 16 is a diagram showing a configuration of the sense amplifier and the precharge/equalize circuit shown in FIG. 15.

FIG. 16 shows in more detail the configuration of memory cell and precharge/equalize circuit shown in FIG. 15. In FIG. 16, a word line WL and a pair of bit lines BL and ZBL are shown representatively.

Precharge/equalize circuit PE includes transfer gates PEa and PEb rendered conductive in response to precharge designating signal ϕp for transmitting precharge voltage VBL transmitted on a precharge voltage transmitting line SPE to respective bit lines BL and ZBL.

Memory cell MC includes: a memory cell capacitor MCA for storing information in a charge form; and an access transistor MT rendered conductive in response to the voltage (word line driving signal Rn) on word line WL for connecting memory cell capacitor MCA to a corresponding bit line BL or ZBL. In FIG. 16, access transistor MT is shown to connect memory cell capacitor MCA to bit line BL.

Bit lines BL and ZBL have parasitic capacitances BPCa and BPCb, respectively. Memory cell capacitor MCA has one electrode connected to one conduction terminal of access transistor MT, and the other electrode connected to receive a constant reference voltage Vcp. One electrode of memory cell capacitor MCA functions as a storage node for storing information. The voltage Vcp (cell plate voltage) supplied to the other electrode (cell plate) of memory cell capacitor MCA is generated by a voltage generating circuit formed, for example, of serially connected resistances Ra and Rb. Resistance elements Ra and Rb of this cell plate voltage generating circuit are connected in series between an internal power supply voltage supplying node and a ground line, and generates cell plate voltage Vcp by resistance-dividing internal power supply voltage VCI. The reference voltage generating circuit as explained above may be used as this cell plate voltage generating circuit.

Normally, precharge voltage VBL and cell plate voltage Vcp are each set to a voltage level that is ½ (half) the internal power supply voltage VCI. Now, the operation of the circuit shown in FIG. 16 will be described in brief.

During precharge (during a stand-by cycle), precharge designating signal ϕp is at an H level, transfer gates PEa and PEb are both in an ON state, and bit lines BL and ZBL are precharged to precharge voltage VBL at an intermediate voltage level. When an active cycle starts, precharge designating signal ϕp attains an L level, and transfer gates PEa and PEb both attain an OFF state. When a word line WL addressed, word line driving signal Rn is transmitted onto this word line WL via X decoder ADX (see FIG. 14) to raise its voltage level, and access transistor MT included in memory cell MC is turned ON. Responsively, memory cell capacitor MCA is connected to bit line BL, and the voltage of bit line BL changes from its precharge voltage VBL according to the data stored in memory cell capacitor MCA. This amount of voltage change is determined by the capacitance value of memory cell capacitor MCA and the capacitance value of parasitic capacitance BPCa associated with bit line BL. Since a memory cell is not connected to bit line ZBL, bit line ZBL maintains precharge voltage VBL. Sense amplifier SA is then activated, and senses, amplifies, and latches the difference of voltages that appeared on bit lines BL and ZBL. Then, a column to which a selected memory cell is disposed is selected according to a column select signal from Y decoder (see FIG. 14), and data writing or reading (access) is effected for that selected memory cell.

In the configuration described above, the internal signals shown in FIG. 16 all change between the level of internal power supply voltage VCI and the level of ground voltage Vss. When memory cycle (access cycle) is completed, word line driving signal Rn on word line WL falls to ground voltage Vss level. Access transistor MT within the memory cell is responsively turned OFF.

As internal power supply voltage VCI is lowered, a MOS transistor as a component element is down-sized to maintain the operation characteristics. In such downsizing, however, threshold voltage Vth of access transistor cannot be downscaled according to the scaling rule, due to the following reason.

Normally, a MOS transistor is in an OFF state when its gate and source are at the same voltage. In this state, however, the current is not completely prevented from flowing through the MOS transistor, but a current called a "tail current (subthreshold current)" flows therethrough. Normally, threshold voltage Vth is defined as a gate to source voltage at the time when a MOS transistor having a prescribed channel width allows flow of a drain current at a predetermined current value.

Figure 17:
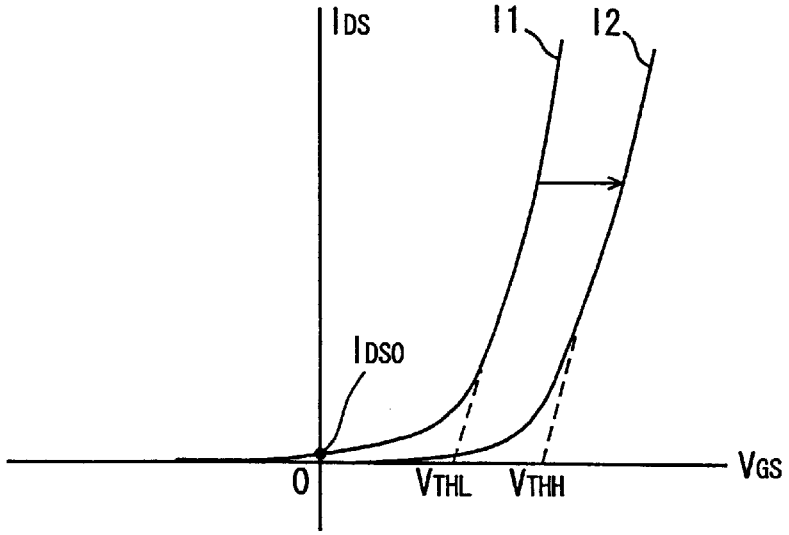
FIG. 17 is a graph showing tail current characteristics of MOS transistor.

FIG. 17 shows tail current characteristics of MOS transistor, with the ordinate representing drain current IDS flowing through MOS transistor, and with the abscissa representing gate to source voltage VGS. As seen from the curve I1, with threshold voltage VTHL, drain current IDS0 flows even when gate to source voltage VG is 0V. To lower this current IDS0 to a substantially negligible level, it is necessary to raise the threshold voltage to a value of VTHH, as shown with curve 12. Note that FIG. 17 shows tail current characteristics of an n channel MOS transistor. The tail current characteristics for a p channel MOS transistor is represented as a curve symmetrical with respect to the vertical axis.

As seen from FIG. 17, a large drain current IDS starts to flow abruptly when threshold voltages VTHL and VTHH become higher than the gate to source voltage VGS. It is thus preferable to use a MOS transistor having a threshold voltage as low as possible to cause the MOS transistor to turn ON at high speed. In the case of semiconductor memory devices, however, the following problem will arise when a MOS transistor having such a low threshold voltage is used as an access transistor of memory cell.

Figure 18:
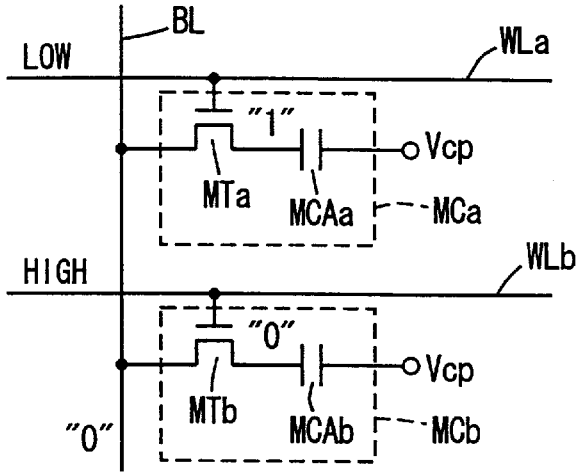
FIG. 18 is a diagram for use in illustration of a reason to differentiate threshold voltages of a memory cell access transistor and of a peripheral circuit MOS transistor.

Now, two memory cells MCa and MCb are considered as shown in FIG. 18. Memory cell MCa includes a memory cell capacitor MCAa, and an access transistor MTa rendered conductive in response to the voltage on word line WLa to connect memory cell capacitor MCAa to bit line BL. Memory cell MCb includes a memory cell capacitor MCAb, and an access transistor MTb rendered conductive in response to the signal voltage on world line WLb to connect memory cell capacitor MCAb to bit line BL.

Now, suppose that data of "0" (L level) is to be written to memory cell MCb in the state where data of "1" (H level) has been stored in memory cell MCa. In this case, the voltage on word line WLa is at an L level of ground voltage Vss level, and the voltage on word line WLb is at an H level (i.e., normally a voltage higher than internal power supply voltage VCI, for preventing threshold voltage loss across access transistor). To write data "0", the voltage of bit line BL is set to ground voltage Vss level. In this state, access transistor MTa of memory cell MCa has its voltage at gate (word line WLa) and its voltage at source (bit line BL) the same each other. Therefore, when a MOS transistor having tail current characteristics as shown by curve I1 in FIG. 17 is used as this access transistor MTa, the tail current will flow from memory cell capacitor MCAa to bit line BL, decreasing the amount of charge stored in memory cell capacitor MCAa. Thus, the charge retention characteristics of memory cell is deteriorated, and reliability of semiconductor memory device is damaged. Further, the data "1" stored in memory cell MCa may change to data "0" due to charge loss because of this tail current. It becomes impossible to realize a semiconductor memory device allowing accurate storage of data, thereby damaging reliability of memory device.

Therefore, in the semiconductor memory device, access transistor MT of memory cell is adapted to have its threshold voltage as high as possible and its tail current as small as possible.

In contrast, peripheral circuits such as address buffer AB, X decoder ADX, Y decoder ADY, and peripheral circuit control circuitry CG, as shown in FIG. 14, are required to operate as fast as possible. Therefore, as a component of peripheral circuit, a MOS transistor with low threshold voltage having tail current characteristics as shown by curve I1 in FIG. 17 is used. Here, the term "low threshold voltage" is used to mean "a threshold voltage small in absolute value". In practice, the threshold voltage of the MOS transistor used in peripheral circuit is set at an appropriate value, taking current dissipation (current consumed during the standby cycle) into consideration.

Accordingly, in a normal semiconductor memory device, a MOS transistor having low threshold voltage and another MOS transistor having high threshold voltage (threshold voltage large in absolute value) are used. A manufacturing method of these MOS transistors having different threshold voltages includes the following steps. First, MOS transistors having the same threshold voltage, i.e., low threshold voltage, are formed in both the peripheral circuit and the memory cell array portion. Next, only for the access transistor of memory cell, p type impurity, e.g., boron, is ion implanted to the surface of channel region under its gate electrode, to increase p type impurity concentration of the surface of channel region of the access transistor. The threshold voltage of access transistor is increased. Accordingly, the typical manufacturing method of semiconductor memory device include steps of differentiating the threshold voltage of access transistor in memory cell array portion from that of MOS transistor included in peripheral circuit.

In the present embodiment, such steps are used to differentiate threshold voltages of p channel MOS transistors Q1 and Q2 included in the reference voltage generating circuit. Hereinbelow, the manufacturing method of semiconductor device according to the sixth embodiment of the present invention will be described with reference to the drawings.

Figure 19:
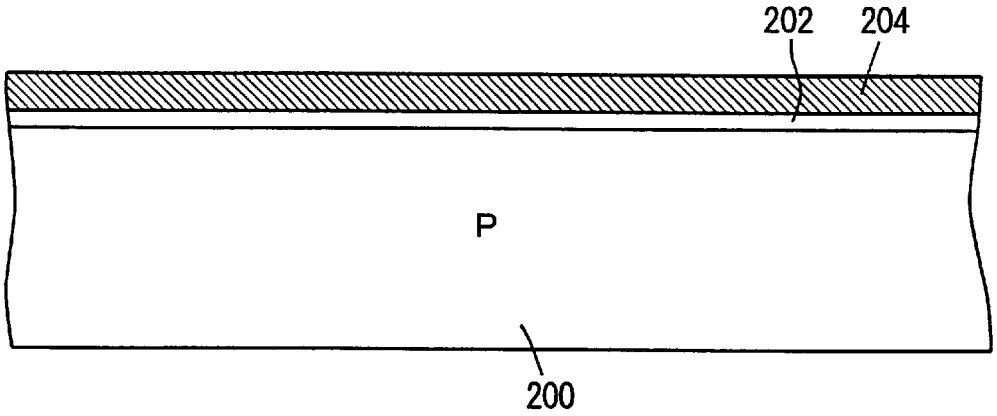
FIGS. 19 to 27 are cross sectional diagrams showing successive steps of the manufacturing method of a semiconductor device according to a sixth embodiment of the present invention.

First, as shown in FIG. 19, a thin, thermal oxide film (pad oxide film) 202 is grown on the surface of P type semiconductor substrate 200 by a thermal oxidation method. A silicon nitride film 204 is then deposited on this thermal oxide film 202 by CVD (chemical vapor deposition), for example, to form double layer insulating film.

Figure 20:
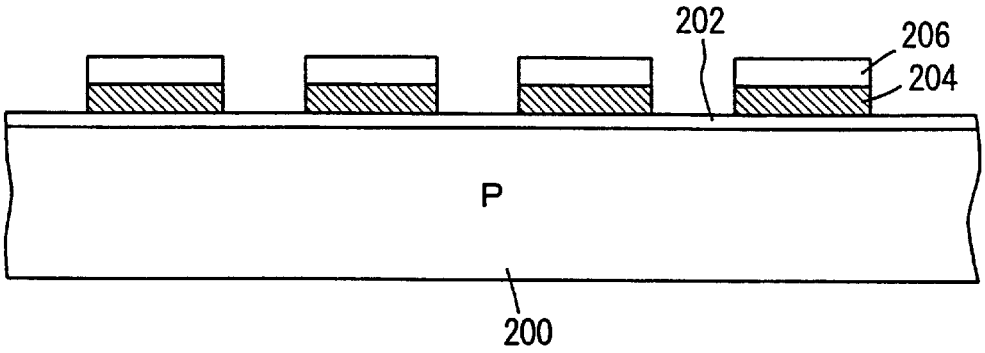

Next, as shown in FIG. 20, a resist film is formed on silicon nitride film 204. This resist film is then patterned by photolithography and etching to form resist pattern 206. Using this resist pattern 206 as a mask, silicon nitride film 204 is selectively etched away, to expose pad oxide film 204 in a portion to be an element isolation region.

Figure 21:
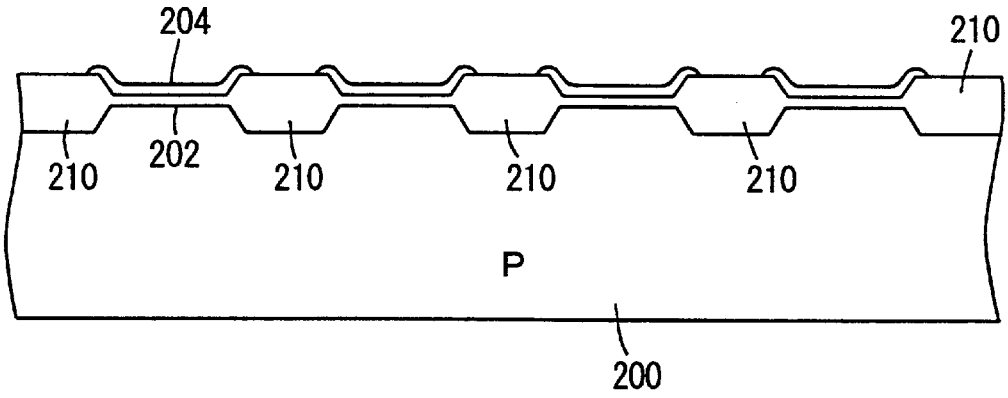

Next, as shown in FIG. 21, after resist pattern 206 is removed, thermal oxidation is performed using silicon nitride film 204 as a mask, to selectively grow a thick silicon dioxide film (field oxide film) 210 in the element isolation region. This method of forming an oxide film by selective thermal oxidation is called LOCOS (local oxidation of silicon). This field oxide film 210 delimits a MOS transistor forming region.

Under this thermal oxide film 210, P type impurity, e.g., boron, is ion-implanted prior to LOCOS, to prevent formation of parasitic MOS transistor. A channel stopper region is formed under field oxide film (thermal oxide film) 210.

Figure 22:
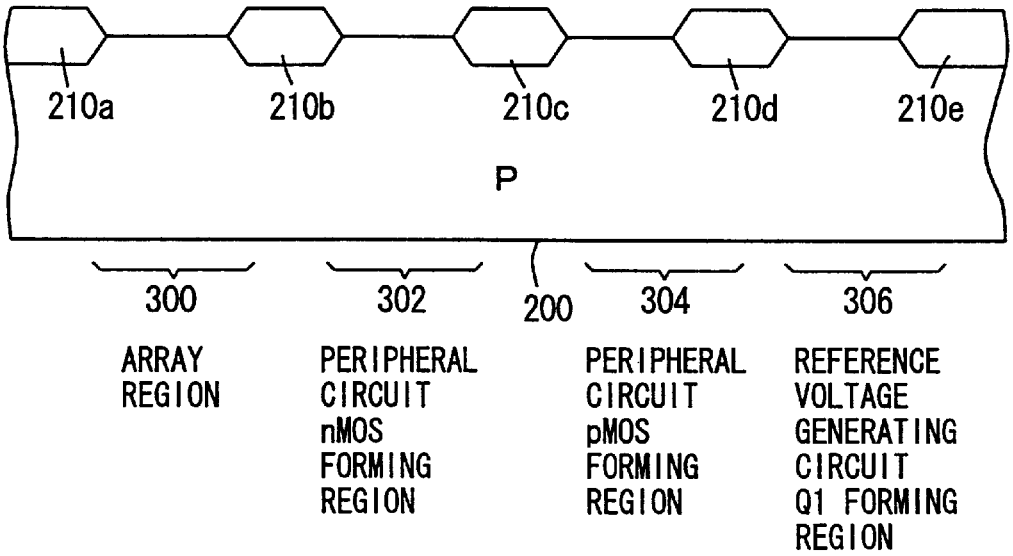

Next, as shown in FIG. 22, unnecessary silicon nitride film 204 and pad oxide film 202 are etched away, to expose the surface of semiconductor substrate 200.

Thereafter, the process enters a step of actually manufacturing MOS transistors as components of memory cell array, peripheral circuit and reference voltage generating circuit. In the following description of the manufacturing steps, the following regions are assumed. A region 300 between field oxide films 210*a* and 210*b* is utilized as an array region in which a memory cell is to be formed, and an access transistor (n channel MOS transistor) is formed in region 300. In a region 302 between field oxide films 210*b* and 210*c*, an n channel MOS transistor for a peripheral circuit is formed. The peripheral circuit is, as described above, an internal circuit for controlling the access of semiconductor memory device, and includes, at a gate level, structures such as an inverter, a NAND gate, and a NOR gate. This peripheral circuit includes both n channel and p channel MOS transistors.

Figure 23:
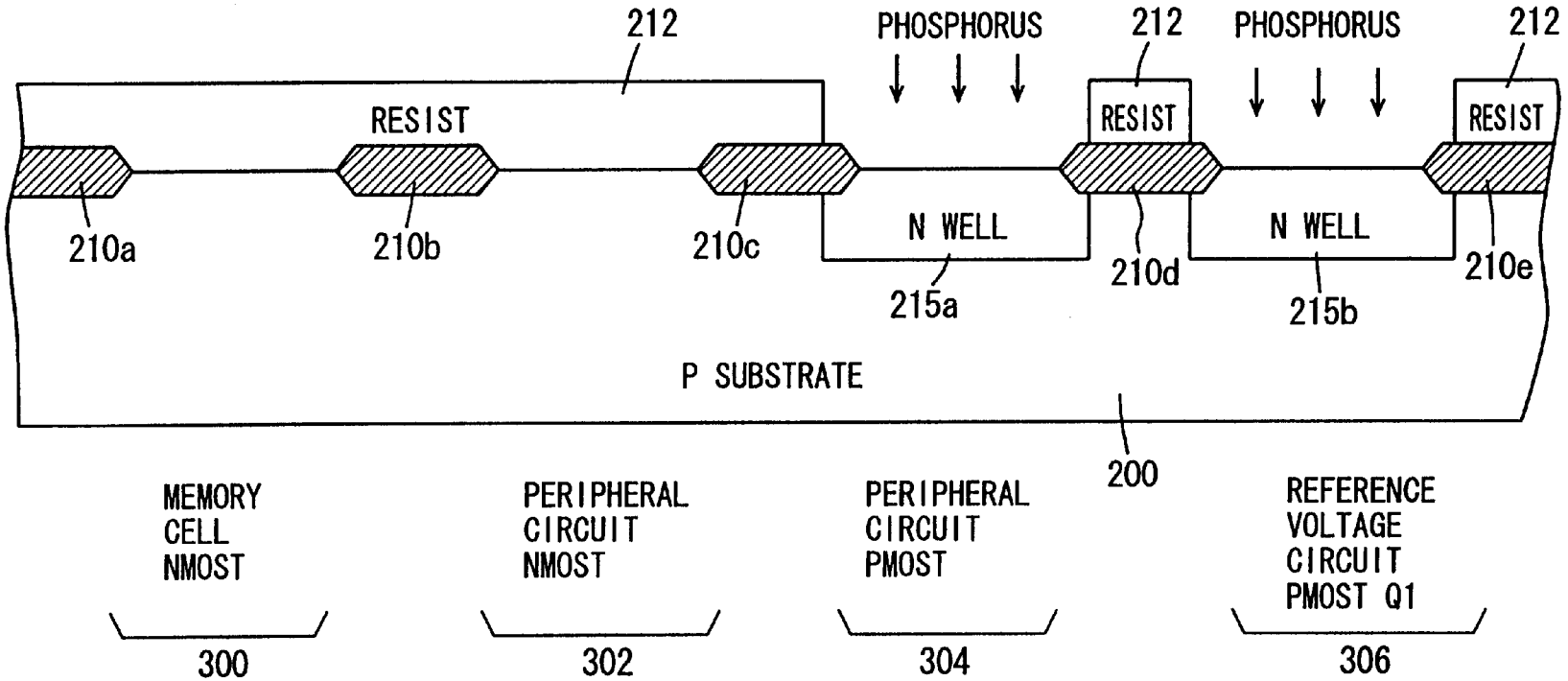

A region 304 between field oxide films 210*c* and 210*d* is used as a region for forming a p channel MOS transistor included in the peripheral circuit. A region 306 between field oxide films 210*d* and 210*e* is used to form a p channel MOS transistor included in the reference voltage generating circuit. In this region 306, the p channel MOS transistor Q1 of the output stage shown in FIG. 1 is formed. As shown in FIG. 23, first, a resist film 212 is formed on the entire surface of semiconductor substrate 200 by spin coating or the like. A resist pattern is then formed by photolithography and etching. The surfaces of peripheral circuit forming region 304 and of reference voltage generating circuit forming region 306 are exposed. In this state, N type impurity, e.g., phosphorus, is ion-implanted at energy of the order of 1000 KeV with doses of the order of $1\times10^{13}$ $cm^{-3}$, for example, to form N wells 215*a* and 215*b*, which are formed of N type impurity regions on the surface of P type semiconductor substrate. These N wells 215*a* and 215*b* serve as substrate regions for MOS transistors in peripheral circuit forming region 304 and in reference voltage generating circuit forming region 306, respectively.

Figure 24:
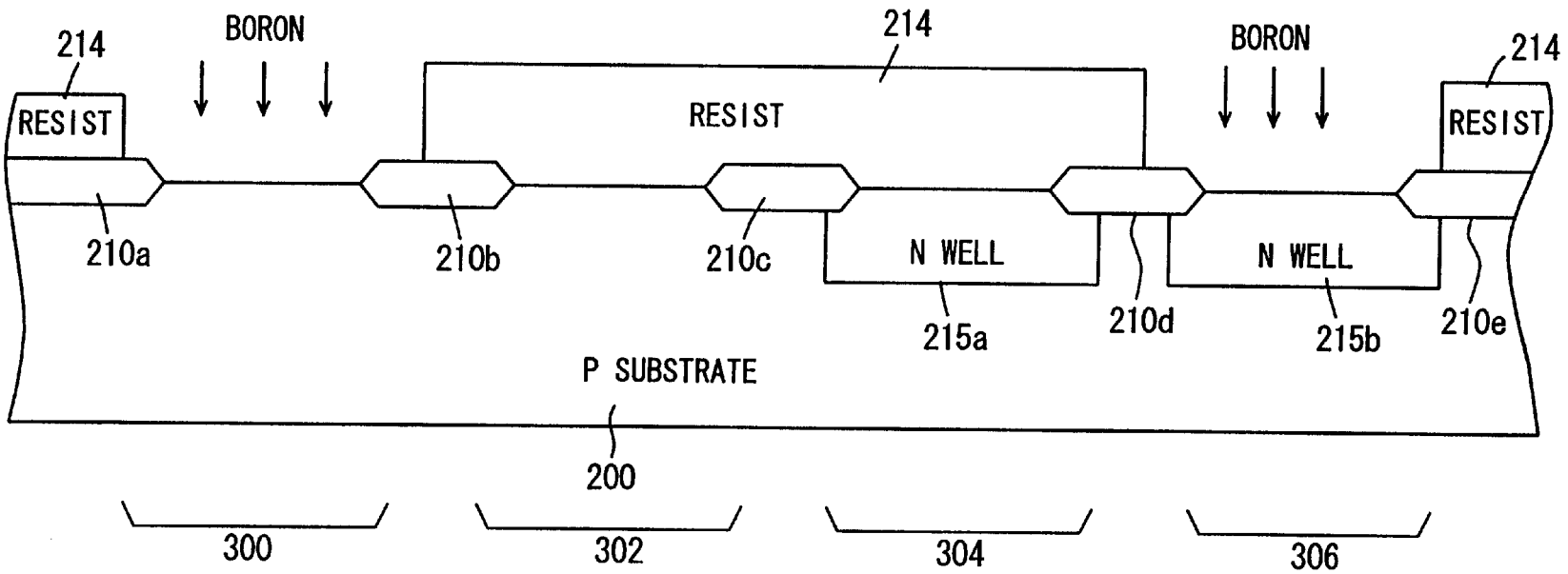

Next, as shown in FIG. 24, after removing resist pattern 212, a resist film is formed again, and a resist pattern 214 is formed by photolithography. This resist pattern 214 covers peripheral circuit forming regions 302 and 304, and exposes region 300 for forming access transistor of memory array and the region for forming MOS transistor Q1 of reference voltage generating circuit. In this state, P type impurity, e.g., boron, is ion-implanted at energy of the order of 50 KeV with doses of the order of $1\times10^{12}$ $cm^{-3}$. In region 300 for forming access transistor of memory array, P type impurity concentration at the substrate surface is made high, and the threshold voltage of access transistor is raised. On the other hand, the surface of N well 215*b* of region 306 attains high P type impurity concentration, and the absolute value of threshold voltage of p channel MOS transistor to be formed therein is made small. By this ion-implantation, the threshold voltage of access transistor to be formed in region 300 becomes higher by approximately 0.3V than the threshold voltage of n channel MOS transistor of peripheral circuit to be formed in region 302. The threshold voltage of p channel MOS transistor Q1 to be formed in region 306 is made smaller in absolute value by about 0.3V than the threshold voltage of p channel MOS transistor of peripheral circuit to be formed in region 304.

Figure 25:
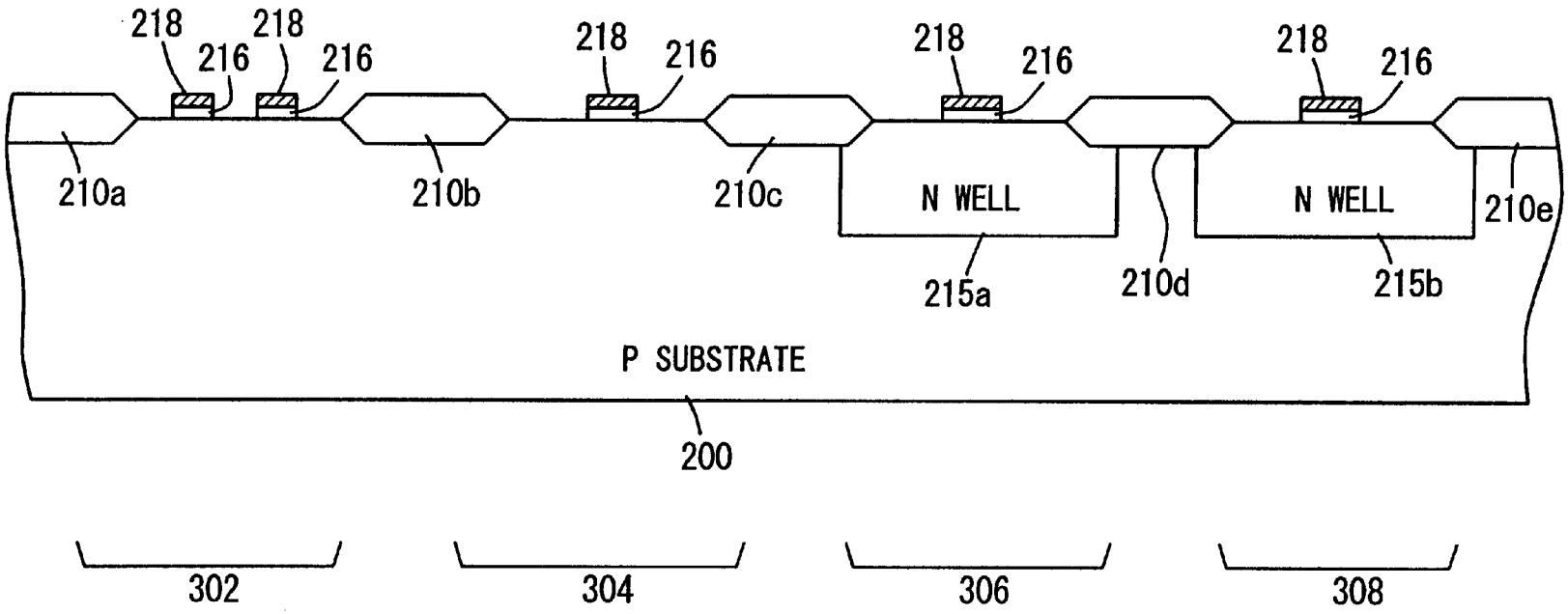

Next, after removal of resist pattern 214, as shown in FIG. 25, an oxide film 216 with a film thickness on the order of 150A is formed on the surface of semiconductor substrate 200. On oxide film 216, low-resistance polysilicon doped with impurity is deposited by CVD or the like. Thereafter, a resist pattern is formed on the polysilicon film by photolithography and etching, and using this resist pattern as a mask, polysilicon and oxide films are selectively etched away. Thus, gate electrode structures of MOS transistors, each having a gate oxide film 216 and gate electrode 218, are formed in regions 302, 304, 306 and 308, respectively.

Here, oxide film 216 may be other insulating film (e.g., silicon oxinitride film). Polysilicon film 218 may also be formed of a refractory metal silicide layer such as molybdenum silicide layer.

Figure 26:
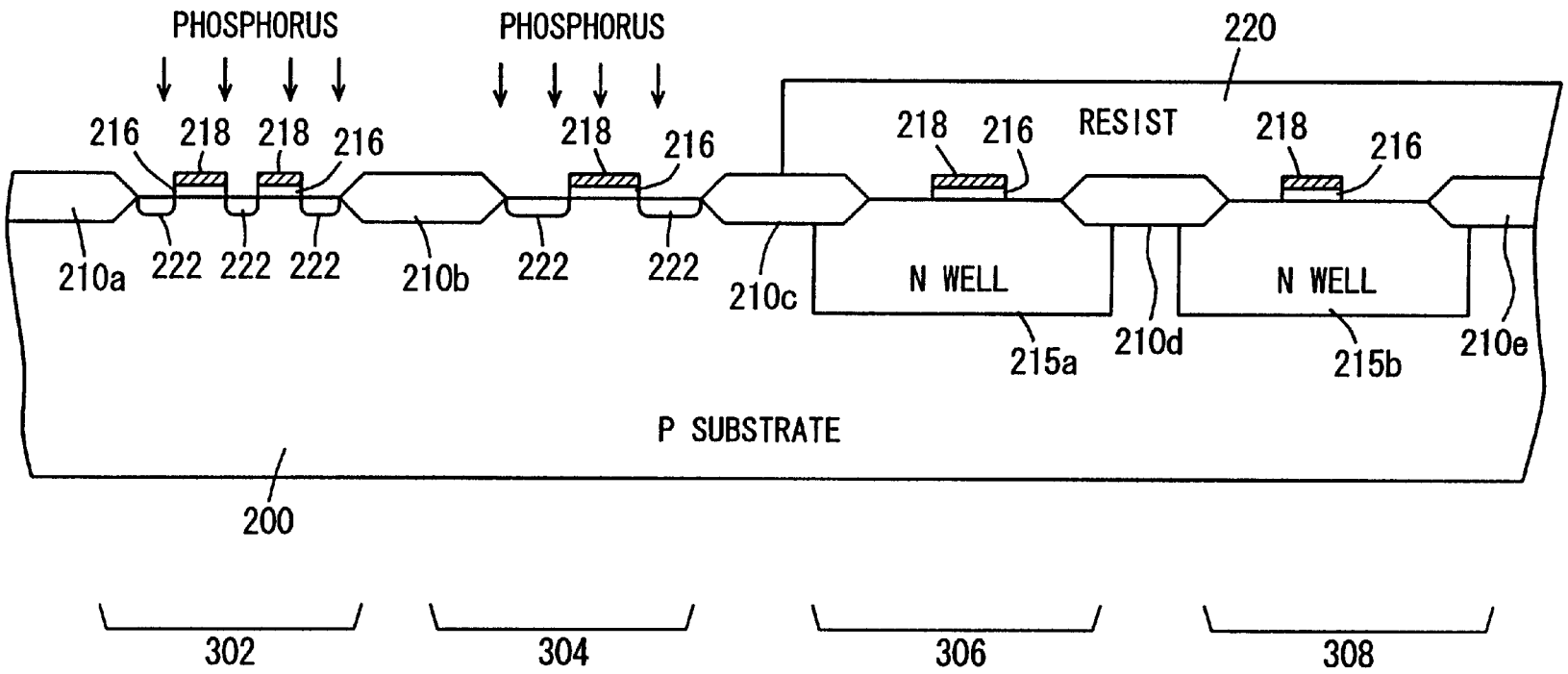

Next, as shown in FIG. 26, regions 306 and 308 in which p channel MOS transistors are to be formed are first covered by resist pattern 220, and using this resist pattern 220 as a mask, N type impurity, e.g., phosphorus, is ion-implanted. Thus, in regions 302 and 304, low-resistance, high-concentration N type impurity regions 222 are formed self-alignedly with gate electrode structure formed of oxide film 216 and polysilicon film 218 as a mask. The source/drain regions of n channel MOS transistor are thus formed.

Figure 27:
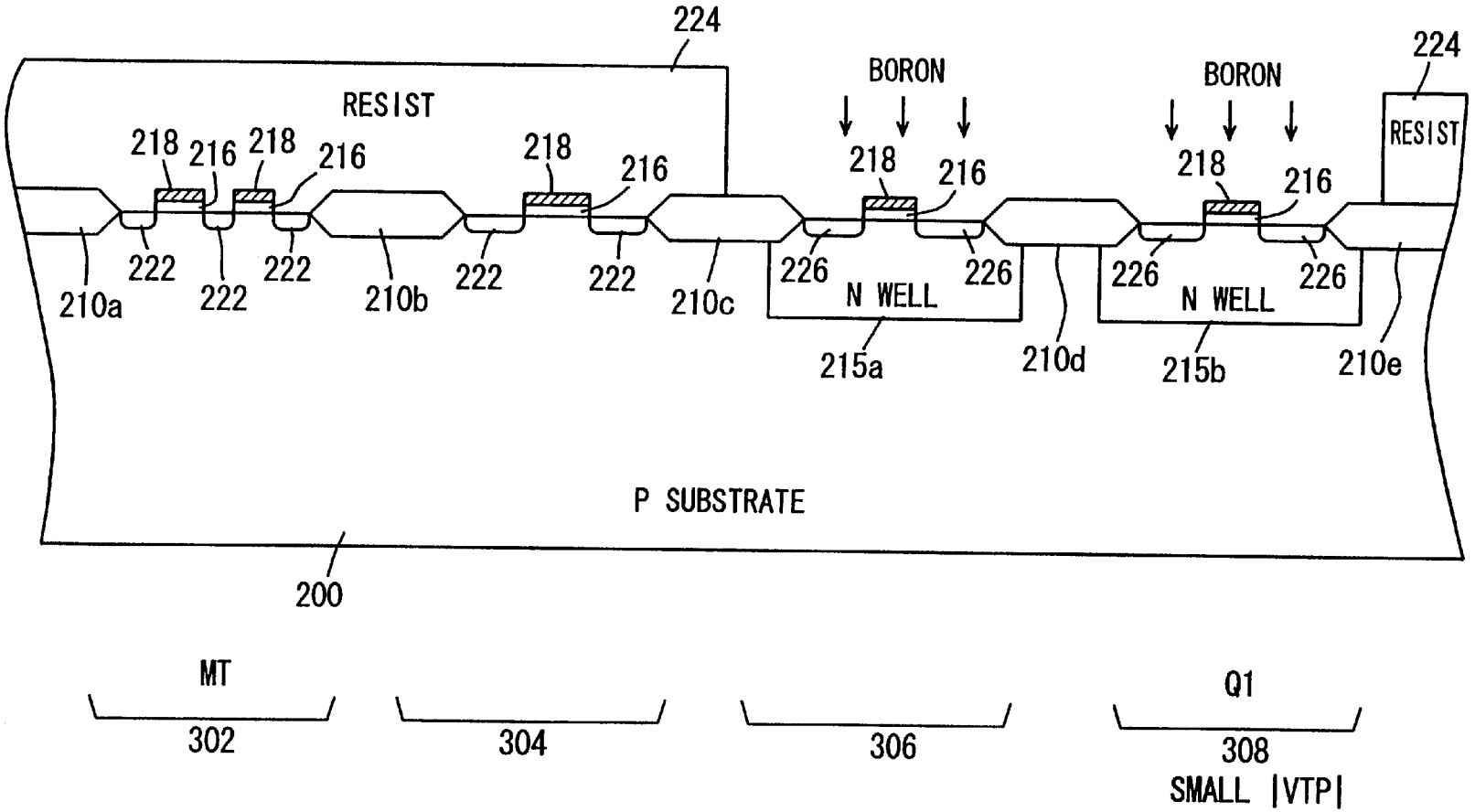

Next, as shown in FIG. 27, after removing resist pattern 220, a resist film is formed again, and a resist pattern 224 is formed by photolithography and etching to cover regions 302 and 304 in which n channel MOS transistors have been formed. In this state, as shown in FIG. 27, region 306 for forming p channel MOS transistor of peripheral circuit and region 308 for forming p channel MOS transistor of reference voltage generating circuit are exposed. P type impurity, e.g., boron, is then ion-implanted to form low-resistance, high-concentration P type impurity regions 226 self-alignedly in N wells 215*a* and 215*b*. Thus, in regions 306 and 308, source/drain regions of p channel MOS transistors are formed.

After removing resist pattern 224, electrode interconnection lines are formed as necessary, and formation of semiconductor device is completed.

As described above, P type impurity ion-implantation into the substrate surface immediately below the gate electrode forming region for the purpose of increasing the threshold voltage of access transistor (n channel MOS transistor) included in a memory cell is effected at the same time with ion-implantation of P type impurity into the surface of substrate region immediately below the gate electrode forming region of output p channel MOS transistor of the reference voltage generating circuit (see FIG. 24). Therefore, a semiconductor device including p channel MOS transistors having at least two threshold voltages different from each other can be realized without increasing manufacturing steps. The p channel MOS transistor formed in N well 215*b* shown in FIG. 27 is used as p channel MOS transistor Q1 in the output stage for generating a reference voltage. Threshold voltages of the other MOS transistors, i.e., MOS transistor Q2 and MOS transistors included in gate control circuit 10, are set substantially equal to the threshold voltage of p channel MOS transistor formed in N well 215*a* included in peripheral circuit forming region 306.

Thus, it is possible to fabricate p channel MOS transistors having desired two kinds of threshold voltages in the reference voltage generating circuit, without increasing the manufacturing steps.

Note that in the above-described embodiment, n channel MOS transistors are formed on the surface of P type semiconductor substrate in regions 302 and 304. These n channel MOS transistors in regions 302 and 304 may each be formed within P well formed on the surface of P type semiconductor substrate 200. Further, a triple well structure may be used, in which a well region of the second conductivity type is further formed within the well region of the first conductivity type, and MOS transistor is formed within that well region of the second conductivity type.

Modification

Figure 28:
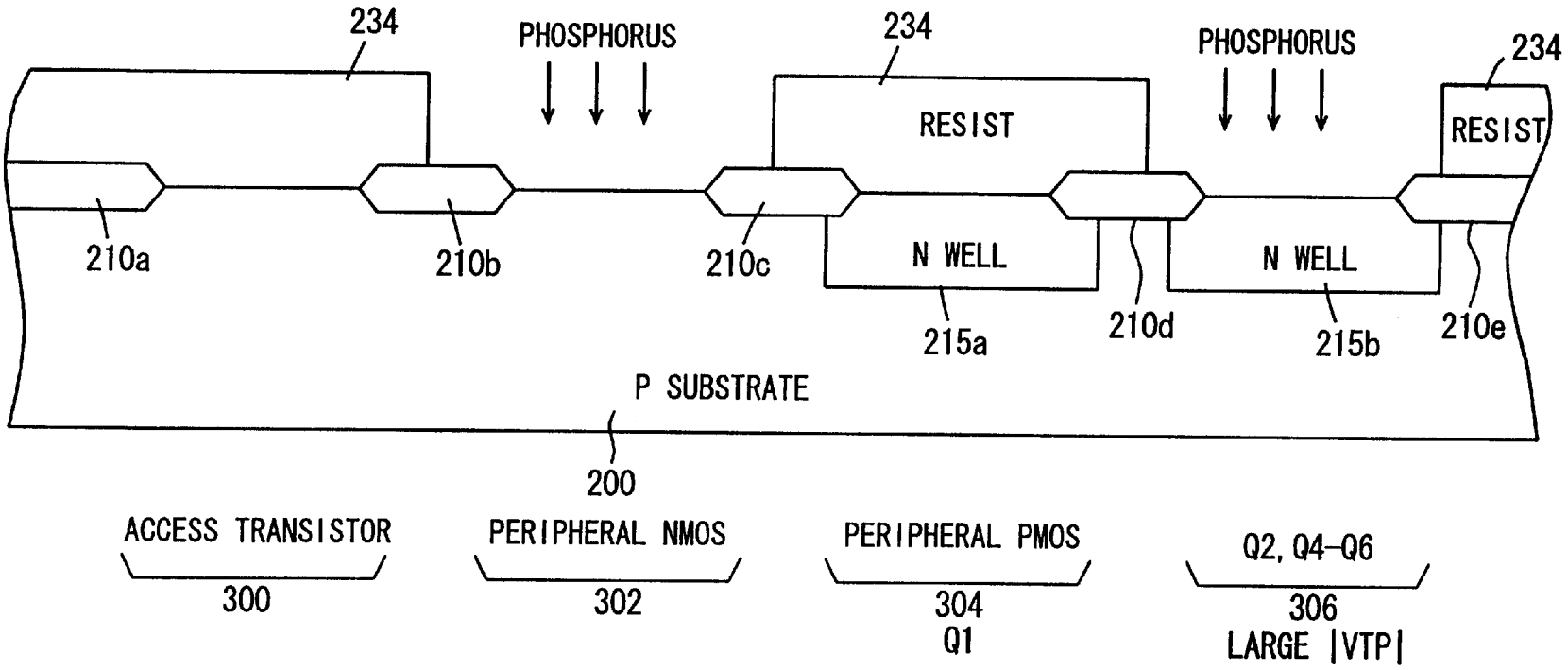
FIG. 28 is a cross sectional diagram showing a step of a modification of the sixth embodiment of the present invention.

FIG. 28 schematically shows a cross sectional structure of the semiconductor device in the main step of a modification of the sixth embodiment of the present invention. The step implementing the cross sectional structure shown in FIG. 28 corresponds to the step previously 30 shown in FIG. 24. Prior to the step shown in FIG. 28, steps identical to those described above with reference to FIGS. 19 to 23 have been performed, except that the P type impurity concentration of the surface of P type semiconductor substrate 200 is made higher than that in the previous embodiment. In the stage preceding the step shown in FIG. 28, P type impurity concentration in region 300 for forming an access transistor of a memory cell and region 302 for forming an n channel MOS transistor of a peripheral circuit is relatively high, and threshold voltages of n channel MOS transistors to be formed in these regions 300 and 302 are made high.

That is, the threshold voltage of n channel MOS transistor of peripheral circuit is set high, similar to that of access transistor of memory cell.

This step of fabricating n channel MOS transistor having its threshold voltage coincident with that of access transistor of memory cell is realized by ion-implanting P type impurity ions at an accelerating energy, e.g., of 50 KeV in a step preceding or succeeding the step of forming N wells 215*a* and 215*b* previously shown in FIG. 23. With such small accelerating energy, this P type impurity is introduced only into a surface portion of the channel forming region in semiconductor substrate 200.

After formation of N wells 215*a* and 215*b*, or, after raising P type impurity concentration of the surface of P type semiconductor substrate 200, the step shown in FIG. 28 is carried out. That is, a resist pattern 234 is first formed to expose the surfaces of region 302 for forming n channel MOS transistor of peripheral circuit as well as of region 306 for forming p channel MOS transistor being a component of reference voltage generating circuit. N type impurity, e.g., phosphorus, is then ion-implanted at a relatively low accelerating energy to the surface regions of regions 302 and 306. In this case, since N type impurity ions are introduced into region 302, the threshold voltage of n channel MOS transistor to be formed in this region 302 is lowered, and an MOS transistor having a low threshold voltage is realized. On the other hand, in region 306, N type impurity ions are further introduced into the surface of N well 215*b*, and the absolute value of threshold voltage of p channel MOS transistor to be formed in this N well 215*b* is increased.

The absolute value of threshold voltage of p channel MOS transistor necessary in this region 306 is made large, and then, the steps shown previously in FIGS. 25 and thereafter are carried out, to form MOS transistors necessary in respective regions.

According to the manufacturing method shown in FIG. 28, a p channel MOS transistor having a threshold voltage that is made higher in absolute value can be realized. Therefore, in this case, the absolute value of threshold voltage of MOS transistor to be formed in region 306 is made higher than any other p channel MOS transistors in the reference voltage generating circuit. Accordingly, in the configuration of the previously described reference voltage generating circuit, MOS transistor formed in region 306 is to be used as p channel MOS transistors Q4 to Q6 included in gate control circuit 10 for setting the gate voltage of output MOS transistor Q1 and as output MOS transistor Q2. P channel MOS transistor Q1 in the output stage is formed within N well 215*a* of region 304.

Note that the manufacturing method of semiconductor device described in the sixth embodiment is not only applicable to the configuration of reference voltage generating circuit shown in previous embodiments 1 through 5, but also applicable to implementation of any circuit that requires at least two kinds of threshold voltages.

As described above, according to the sixth embodiment of the present invention, impurity of the first conductivity type is ion-implanted to at least portions of the substrate region of the first conductivity type as well as the substrate region of the second conductivity type. Accordingly, a circuit having two kinds of threshold voltages necessary for generating a desired internal voltage, e.g., a reference voltage, can be implemented with no need of any additional manufacturing step.

Other Applications

Output voltage Vo or Vr of the reference voltage generating circuit may be used not only for generating an internal power supply voltage, but also as cell plate voltage Vcp, as previously described with reference to FIG. 16. The output voltage Vo or Vr may further be used as a reference voltage providing a criterion for H and L levels of a signal. Output voltages Vo and Vr may also be used as bias voltages to be supplied to a gate or a base of a constant-current source transistor. Furthermore, this reference voltage generating circuit may be used in both digital and analog integrated circuits.

As described above, according to the present invention, the gate voltage of MOS transistor for generating an output voltage is held at a constant voltage level by a feedback loop. Therefore, it is possible to generate, with ease, an output voltage at a constant voltage level independent of fluctuation of operating power supply voltage of the reference voltage generating circuit.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A reference voltage generating circuit, comprising:

a first output field effect transistor having a gate, for supplying a current from a first power supply node to an output node in accordance with a voltage applied to the gate;

a second output field effect transistor having a gate receiving a bias voltage at a predetermined voltage level, for discharging a current from said output node to a second power supply node in accordance with said bias voltage; and a gate control circuit for applying a voltage to cancel a dependency of a voltage at said output node on a voltage at said first power supply node to the gate of said first output field effect transistor, said gate control circuit including a feedback loop for holding the gate voltage of said first output field effect transistor at a prescribed voltage level through negative feedback of the gate voltage of said first output field effect transistor.

2. The reference voltage generating circuit according to claim 1, wherein said gate control circuit includes a first resistance element coupled between said first power supply node and a first node, a first feedback field effect transistor coupled between said first power supply node and a second node and having a gate coupled to said first node, a voltage down element connected between said second node and a third node for dropping a voltage at said second node by a prescribed value for transmission, a second feedback field effect transistor connected between said first node and said second power supply node and having a gate connected to said third node, and a second resistance element coupled between said third node and said second power supply node.

3. The reference voltage generating circuit according to claim 2, wherein the first and second output field effect transistors each are an insulated gate type field effect transistor of a first conductivity type, the first and second feedback field effect transistors each are an insulated gate type field effect transistor of said first conductivity type, and said voltage down element includes a diode-connected insulated gate type field effect transistor of said first conductivity type.

4. The reference voltage generating circuit according to claim 2, wherein the first and second output field effect transistors each are an insulated gate type field effect transistor of a first conductivity type, the first and second feedback field effect transistors each are an insulated gate type filed effect transistor of said first conductivity type, and said voltage down element is a diode-connected insulated gate type field effect transistor of a second conductivity type.

5. The reference voltage generating circuit according to claim 1, wherein the gate of said second output field effect transistor is coupled to said second power supply node.

6. The reference voltage generating circuit according to claim 1, wherein the gate of said second output field effect transistor receives, as said bias voltage, a voltage that is lower than the voltage at said second power supply node.

7. The reference voltage generating circuit according to claim 1, further comprising a source follower transistor for transmitting the voltage at said output node to a second output node by source follower mode operation.

8. The reference voltage generating circuit according to claim 1, wherein said first power supply node receives a boosted voltage higher than a power supply voltage.

9. The reference voltage generating circuit according to claim 1, wherein each of the first and second output field effect transistors allows trimming of a conductance factor that is proportional to a ratio between channel width and channel length.

10. The reference voltage generating circuit according to claim 1, wherein the voltage at said output node is used to generate a voltage for driving a memory circuit including a plurality of memory cells each having a capacitor for storing information and an access transistor formed of a field effect transistor of a first conductivity type for accessing said capacitor, and said first output field effect transistor includes a field effect transistor of a second conductivity type, and having a channel region in which impurity for adjusting a threshold voltage thereof exists, said impurity being introduced at the same time with ion implantation into a channel region of said access transistor.

11. The reference voltage generating circuit according to claim 1, wherein said voltage at said output node is used to generate a voltage for driving a memory peripheral circuit that selects a memory cell of a memory cell array, and said second output field effect transistor is of a second conductivity type and has a channel region in which impurity for adjusting a threshold voltage thereof exists, said impurity being introduced at the same time with ion implantation into a channel region of a first conductivity type field effect transistor of said memory peripheral circuit.

12. A reference voltage generating circuit, comprising:

a first resistance element coupled between a first power supply node and a first node;

a first voltage driven type feedback transistor coupled between said first power supply node and a second node, and having a gate coupled to said first node;

a voltage down element connected between said second node and a third node for down-converting a voltage of said second node by a prescribed value for transmission to said third node;

a second voltage driven type feedback transistor connected between said first node and a second power supply node and having a gate connected to said third node; and a second resistance element coupled between said third node and said second power supply node.

13. The reference voltage generating circuit according to claim 12, wherein the first and second voltage driven type feedback transistors each are an insulated gate type field effect transistor of a first conductivity type, and said voltage down element is a diode-connected insulated gate type field effect transistor of said first conductivity type.

14. The reference voltage generating circuit according to claim 12, wherein said first and second voltage driven type feedback transistors each are an insulated gate type field effect transistor of a first conductivity type, and said voltage down element is a diode-connected insulated gate type field effect transistor of a second conductivity type.

15. The reference voltage generating circuit according to claim 12, wherein resistance values of the first and second resistance elements are larger than respective ON resistances of the second and first voltage driven type feedback transistors.

16. The reference voltage generating circuit according to claim 12, further comprising a first output field effect transistor having a gate receiving a voltage of said output node for supplying a current to a second output node in accordance with the voltage received at the gate thereof.

17. The reference voltage generating circuit according to claim 16, further comprising a source follower transistor for transmitting a voltage of said second output node to a third output node by source follower mode operation.

18. The reference voltage generating circuit according to claim 12, wherein said first power supply node receives a boosted voltage higher than a power supply voltage.

19. The reference voltage generating circuit according to claim 16, further comprising a second output field effect transistor coupled between said second output node and said second power supply node and having a gate receiving a prescribed voltage for discharging said second output node.

20. The reference voltage generating circuit according to claim 19, wherein the voltage at said second output node is used to generate a voltage for driving a memory circuit, said memory circuit including an array of a plurality of memory cells each having a capacitor for storing information and an access transistor formed of a first conductivity type field effect transistor for accessing said capacitor, and the first and second output field effect transistors each are an insulated gate type field effect transistor of a second conductivity type and having a channel region in which impurity for adjusting a threshold voltage thereof exists, said impurity being introduced at the same time with ion implantation into a channel region of a field effect transistor included in said memory circuit.

* * * * *